US006729712B2

(12) United States Patent
Kobayashi et al.

(10) Patent No.: US 6,729,712 B2
(45) Date of Patent: May 4, 2004

(54) PRINTING APPARATUS AND PRINTING CONTROL METHOD

(75) Inventors: Nobutsune Kobayashi, Kanagawa (JP); Michiharu Shoji, Kanagawa (JP); Hiroyuki Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 32 days.

(21) Appl. No.: 10/144,857

(22) Filed: May 15, 2002

(65) Prior Publication Data

US 2002/0171702 A1 Nov. 21, 2002

(30) Foreign Application Priority Data

May 17, 2001 (JP) ..... 2001-148343

(51) Int. Cl.[7] ..... B41J 29/393
(52) U.S. Cl. ..... 347/19
(58) Field of Search ..... 347/19, 14, 23, 347/104, 15, 37, 16, 5, 12, 10, 11, 8; 400/582

(56) References Cited

U.S. PATENT DOCUMENTS

| | | | |
|---|---|---|---|
| 4,146,922 A | 3/1979 | Brown et al. | 700/69 |
| 4,490,796 A | 12/1984 | Bigbie et al. | 358/1.14 |
| 4,869,610 A | 9/1989 | Nishizawa et al. | 400/322 |
| 5,207,520 A | 5/1993 | Tanaka | 400/279 |
| 5,998,956 A | 12/1999 | Saito | |
| 6,065,830 A | 5/2000 | Hiramatsu et al. | |

FOREIGN PATENT DOCUMENTS

| | | |
|---|---|---|
| EP | 0 312 324 | 4/1989 |
| EP | 0 373558 | 6/1990 |
| EP | 0 666 179 | 8/1995 |
| JP | 64-26386 | 1/1989 |
| JP | 4-244875 | 9/1992 |
| JP | 9-95023 | 4/1997 |
| JP | 9-202014 | 8/1997 |
| JP | 2000-52599 | 2/2000 |
| JP | 2000-56634 | 2/2000 |
| JP | 2001-232882 | 8/2001 |
| JP | 2001-246827 | 9/2001 |

*Primary Examiner*—Stephen D. Meler
*Assistant Examiner*—Charles Stewart
(74) *Attorney, Agent, or Firm*—Fitzpatrick, Cella, Harper & Scinto

(57) ABSTRACT

In cross control in sub-scanning (LF) and main scanning (CR), to avoid the risk of skew printing and increase the processing speed, a supposed settling time in the next sub-scanning cycle is obtained on the basis of the history information of the sub-scanning settling time of a printing apparatus, and a supposed idle time from the start of the next main scanning driving cycle to the start of printing is obtained on the basis of the history information of the main scanning acceleration required time. It is determined using the supposed settling time and supposed idle time whether cross control in which main scanning driving starts before the end of sub-scanning driving can be executed in next print scanning processing. If it is possible, the time difference from the start of sub-scanning driving to the start of main scanning driving is determined using the supposed settling time and the supposed idle time.

47 Claims, 22 Drawing Sheets

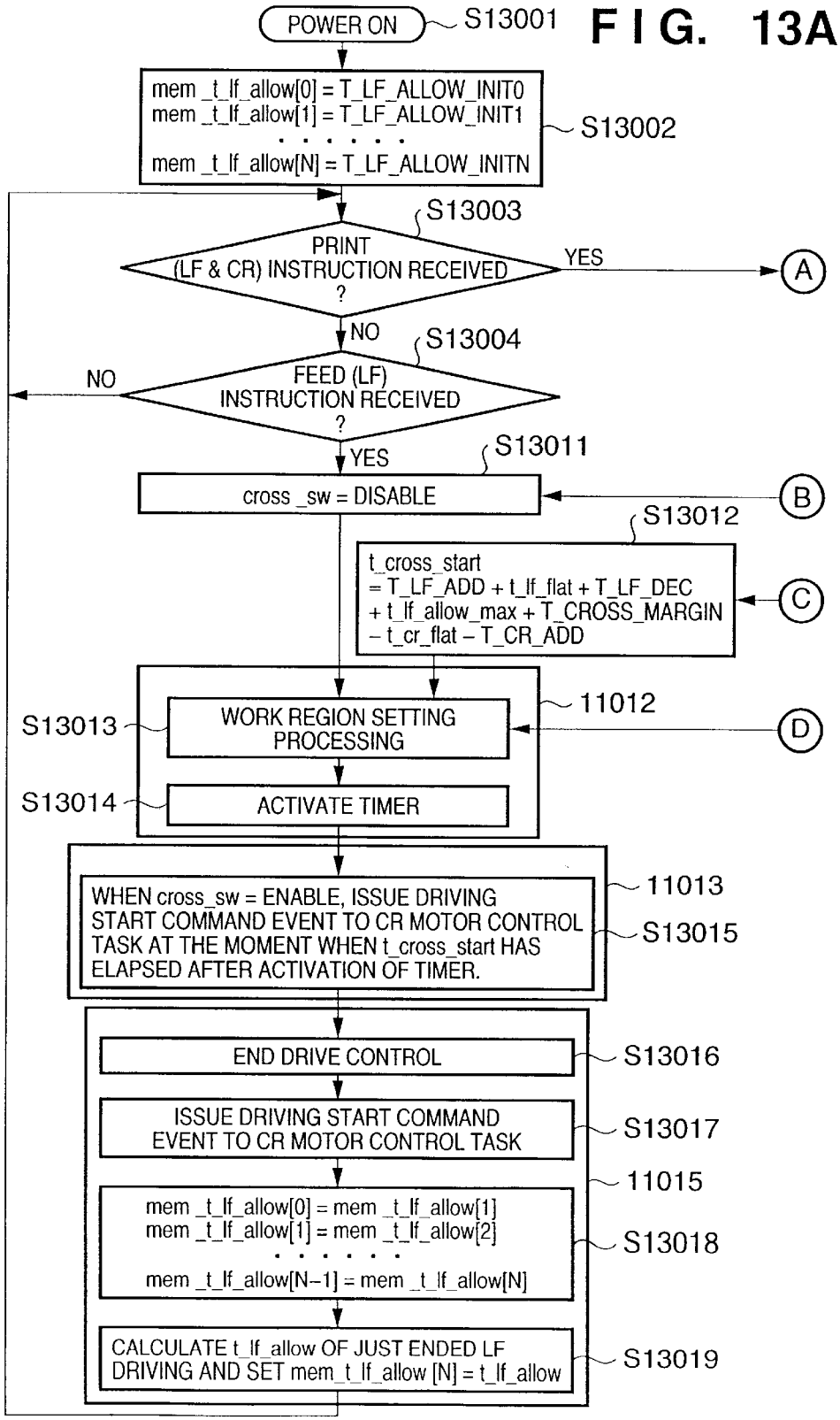
FIG. 13A
POWER ON
S13001
mem _t_lf_allow[0] = T_LF_ALLOW_INIT0
mem _t_lf_allow[1] = T_LF_ALLOW_INIT1
. . . . . .
mem _t_lf_allow[N] = T_LF_ALLOW_INITN
S13002
S13003
PRINT (LF & CR) INSTRUCTION RECEIVED ?
YES
A
NO
S13004
FEED (LF) INSTRUCTION RECEIVED ?
NO
YES
S13011
cross _sw = DISABLE
B
S13012
t_cross_start = T_LF_ADD + t_lf_flat + T_LF_DEC + t_lf_allow_max + T_CROSS_MARGIN − t_cr_flat − T_CR_ADD
C
11012
S13013
WORK REGION SETTING PROCESSING
D
S13014
ACTIVATE TIMER
11013
WHEN cross_sw = ENABLE, ISSUE DRIVING START COMMAND EVENT TO CR MOTOR CONTROL TASK AT THE MOMENT WHEN t_cross_start HAS ELAPSED AFTER ACTIVATION OF TIMER.
S13015
END DRIVE CONTROL
S13016
ISSUE DRIVING START COMMAND EVENT TO CR MOTOR CONTROL TASK
S13017
11015
mem _t_lf_allow[0] = mem _t_lf_allow[1]
mem _t_lf_allow[1] = mem _t_lf_allow[2]
. . . . . .
mem _t_lf_allow[N−1] = mem _t_lf_allow[N]
S13018
CALCULATE t_lf_allow OF JUST ENDED LF DRIVING AND SET mem_t_lf_allow [N] = t_lf_allow
S13019

PRINTING APPARATUS AND PRINTING CONTROL METHOD

FIELD OF THE INVENTION

The present invention relates to a printing apparatus which executes cross control as control for realizing high-speed printing in, e.g., a serial printer and, more particularly, to an apparatus which employs, as a driving source, a DC motor or ultrasonic motor whose driving profile dynamically changes, and a control method thereof.

BACKGROUND OF THE INVENTION

In recent years, printers are required to have not only higher image quality but also lower operation noise. Especially, an inkjet printing apparatus which has only a few noise sources in printing uses a DC motor and linear encoder as a driving means for scanning a printhead, thereby reducing noise. Today, a DC motor and rotary encoder are also being employed as a driving means for paper conveyance. For noise reduction, an effect can be expected only by employing a DC motor. However, for accurate conveyance, an advanced stop control technique and mechanical accuracy are necessary.

To stop a DC motor, the motor is basically powered off when the rotation of a roller has reached a target position, thereby stopping the motor by inertia.

To ensure stop accuracy in use of a DC motor, deceleration before stop and removal of disturbance torque before stop (i.e., stable low-speed operation immediately before stop) are indispensable. When the motor is powered off at a constant and sufficiently low speed, the settling time and stop accuracy until stop can be stabilized.

However, it is very difficult to stabilize the acceleration required time in main scanning (CR) to a completely same value in all driving modes or stabilize the settling time in sub-scanning (LF) to a completely same value in all driving modes.

A serial printer requires cross control to increase the processing speed. In this control, timings are managed such that main scanning driving starts before sub-scanning driving is ended, and sub-scanning stops just when main scanning has reached the printing region, in consideration of an expected value of each time value required for printing.

In this arrangement, it is difficult to accurately estimate the expected time because of a variation in acceleration required time in main scanning and a variation in settling time in sub-scanning driven by the DC motor. Hence, without time management with a sufficient margin for errors of expected time, main scanning reaches the printing region while sub-scanning is still operating, resulting in skew printing.

On the other hand, if the margin is too large, cross printing control becomes ineffective, resulting in low processing speed. That is, in executing cross control in a serial printer that employs a DC motor as a driving source, the highly efficient cross control and skew printing avoidance have a contradictory relationship.

The above problem and ideal operation to be realized by the present invention will be briefly described below with reference to FIGS. 1A to 1C.

FIG. 1A is a timing chart showing the sub-scanning (LF) driving pattern. Reference numeral 21 denotes a sub-scanning driving profile. Due to a variation in control system, the time from the start to stop of driving varies to T_1, T_2, and T_3 in driving three times.

FIG. 1B is a timing chart showing the main scanning (CR) driving pattern. Reference numeral 22 denotes a main scanning driving profile; and 23, a printing region. Due to a variation in control system, the time from the start of driving to the start of printing varies to T_4, T_5 , and T_6 in driving three times.

FIG. 1C is a timing chart showing a driving pattern in cross control printing using the sub-scanning driving pattern shown in FIG. 1A and the main scanning driving pattern shown in FIG. 1B. FIG. 1C simply and clearly shows the concept of the present invention. As is apparent from the history in the past, the best balance can be obtained by determining the degree of overlap between main scanning (LF) and main scanning (CR) by the worst conditions in cross control, i.e., T_3 (the moving time in the slowest profile until the end of movement of LF) and T_4 (the printing start time in the profile with the least margin from the start of movement to the start of printing of CR). If the degree of overlap is increased, skew printing is supposed to occur. If the degree of overlap is decreased, a wasteful main scanning idle interval in which main scanning driving does not overlap sub-scanning driving and no printing is executed is supposed to be generated.

SUMMARY OF THE INVENTION

The present invention has been proposed to solve the conventional problems, and has as its object to realize the optimum balance between the sub-scanning driving time and the main scanning driving time in cross control. A printing apparatus and printing control method according to the present invention are mainly characterized by the following arrangements. That is, according to the present invention, a printing apparatus comprises: first storage means for recording a history of a sub-scanning settling time; second storage means for recording a history of a main scanning acceleration required time; supposed settling time determination means for obtaining a supposed settling time in a next sub-scanning driving cycle on the basis of the history information of the sub-scanning settling time stored in the first storage means; supposed idle time determination means for obtaining a supposed idle time from a next start of main scanning driving to a start of printing on the basis of the history information of the main scanning acceleration required time stored in the second storage means; determination means for determining using the supposed settling time and the supposed idle time whether cross control in which main scanning driving starts before an end of sub-scanning driving can be executed in next print scanning processing; and time difference determination means for determining a time difference from a start of sub-scanning driving to the start of main scanning driving using the supposed settling time and the supposed idle time on the basis of determination by the determination means in order to execute cross control in a next print scanning cycle.

Preferably, in the printing apparatus the first storage means stores the sub-scanning settling times in N sub-scanning driving cycles in the past as the history information, and the supposed settling time determination means employs a maximum value stored in the first storage means as the supposed settling time in the next sub-scanning driving cycle.

Preferably, in the printing apparatus, the second storage means stores the main scanning acceleration required times in M main scanning driving cycles in the past as the history information, and the supposed idle time determination means employs a minimum value stored in the second storage means as the supposed idle time in the next main scanning driving cycle.

Preferably, in the printing apparatus, the time difference determination means employs, as the time difference, a time value obtained by adding a predetermined margin time to a time value obtained by subtracting the supposed idle time from the supposed settling time.

Preferably, in the printing apparatus, only when the supposed settling time is shorter than a preset allowable maximum settling time, the determination means determines that cross control can be executed.

Preferably, in the printing apparatus, when the supposed settling time exceeds a preset allowable maximum settling time, the determination means inhibits cross control.

Preferably, in the printing apparatus, when the supposed settling time exceeds a preset allowable maximum settling time, the determination means switches to control for starting main scanning operation after an end of sub-scanning operation.

Preferably, in the printing apparatus, upon powering on, the supposed settling time determination means employs, as an initial condition, a maximum sub-scanning settling time in the history information of the sub-scanning settling times of the N cycles in the past from the first storage means.

Preferably, in the printing apparatus, upon powering on, the supposed idle time determination means employs, as an initial condition, a minimum main scanning acceleration time in the history information of the main scanning acceleration times of the M cycles in the past from the second storage means.

Preferably, in the printing apparatus, the first storage means stores the history information of the sub-scanning settling times of the N cycles in the past in correspondence with each printing condition, and the supposed settling time determination means employs a sub-scanning settling time of a corresponding printing condition as an initial condition in accordance with a print instruction.

Preferably, in the printing apparatus, a DC motor is employed as a main scanning and sub-scanning driving source.

Preferably, in the printing apparatus, the apparatus further comprises first measurement means for measuring a variation in load on a carriage, and the history information of the main scanning acceleration required time stored in the second storage means is initialized on the basis of a measurement result from the first measurement means.

Preferably, in the printing apparatus, the apparatus further comprises second load measurement means for measuring a load variation of a printing medium on a convey mechanism, and the history information of the sub-scanning settling time stored in the first storage means is initialized on the basis of a measurement result from the second load measurement means.

Preferably, in the printing apparatus, the history of the sub-scanning settling time and the history of the main scanning acceleration required time are stored in a nonvolatile memory, and the pieces of information can be held even after power-off.

Preferably, in the printing apparatus, when control is executed by feedback using only speed information without using any position information, the determination means inhibits cross control.

According to the present invention, a printing control method of controlling the printing apparatus comprises: a first storage step of recording a history of a sub-scanning settling time of the printing apparatus in a memory; a second storage step of recording a history of a main scanning acceleration required time of the printing apparatus in a memory; a supposed settling time determination step of obtaining a supposed settling time in a next sub-scanning driving cycle on the basis of the history information of the sub-scanning settling time stored in the first storage step; a supposed idle time determination step of obtaining a supposed idle time from a next start of main scanning driving to a start of printing on the basis of the history information of the main scanning acceleration required time stored in the second storage step; a determination step of determining using the supposed settling time and the supposed idle time whether cross control in which main scanning driving starts before an end of sub-scanning driving can be executed in next print scanning processing; and a time difference determination step of determining a time difference from a start of sub-scanning driving to the start of main scanning driving using the supposed settling time and the supposed idle time on the basis of determination in the determination step in order to execute cross control in a next print scanning cycle.

According to the present invention, a printing control program, which causes a computer to function to control a printing apparatus, comprises: first storage means for recording a history of a sub-scanning settling time; second storage means for recording a history of a main scanning acceleration required time; supposed settling time determination means for obtaining a supposed settling time in a next sub-scanning driving cycle on the basis of the history information of the sub-scanning settling time stored in the first storage means; supposed idle time determination means for obtaining a supposed idle time from a next start of main scanning driving to a start of printing on the basis of the history information of the main scanning acceleration required time stored in the second storage means; determination means for determining using the supposed settling time and the supposed idle time whether cross control in which main scanning driving starts before an end of sub-scanning driving can be executed in next print scanning processing; and time difference determination means for determining a time difference from a start of sub-scanning driving to the start of main scanning driving using the supposed settling time and the supposed idle time on the basis of determination by the determination means in order to execute cross control in a next print scanning cycle.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIGS. 13A and 13B are flow charts for explaining processing according to an embodiment of the present invention in detail;

DETAILED DESCRIPTION OF THE PREFERRED EMBODIMENTS

Preferred embodiments of the present invention will now be described in detail in accordance with the accompanying drawings.

<First Embodiment>

In this embodiment, a serial inkjet printer having a printhead with a detachable ink tank will be exemplified. A case wherein a line feed motor is employed, and in carriage motor control, cross control of the present invention is applied will be described.

"Cross control" means control in which main scanning driving of a carriage with a printhead and sub-scanning driving in conveying a printing medium are cooperatively overlapped.

Figure 1A:
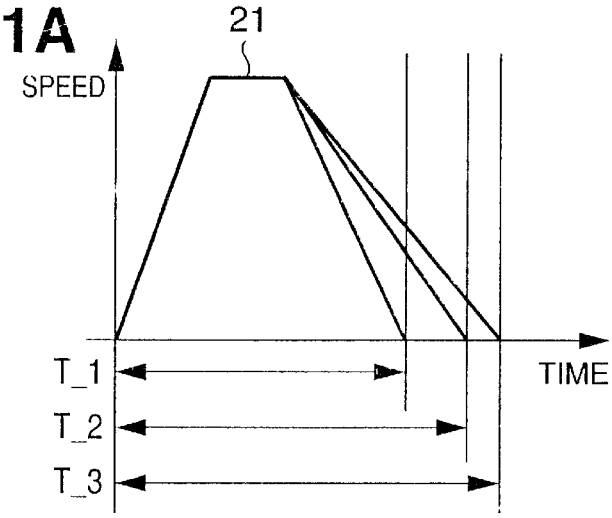
FIGS. 1A to 1C are timing charts for explaining ideal operation in printing control of the present invention.
Figure 1B:
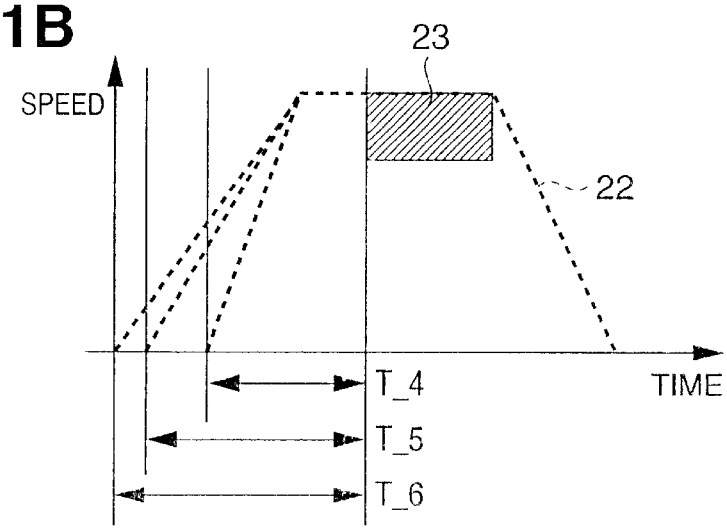
Figure 1C:
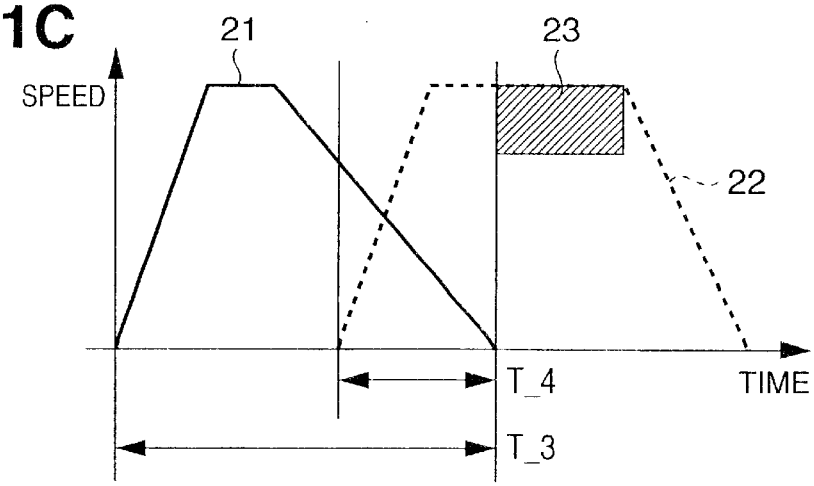
Figure 2:
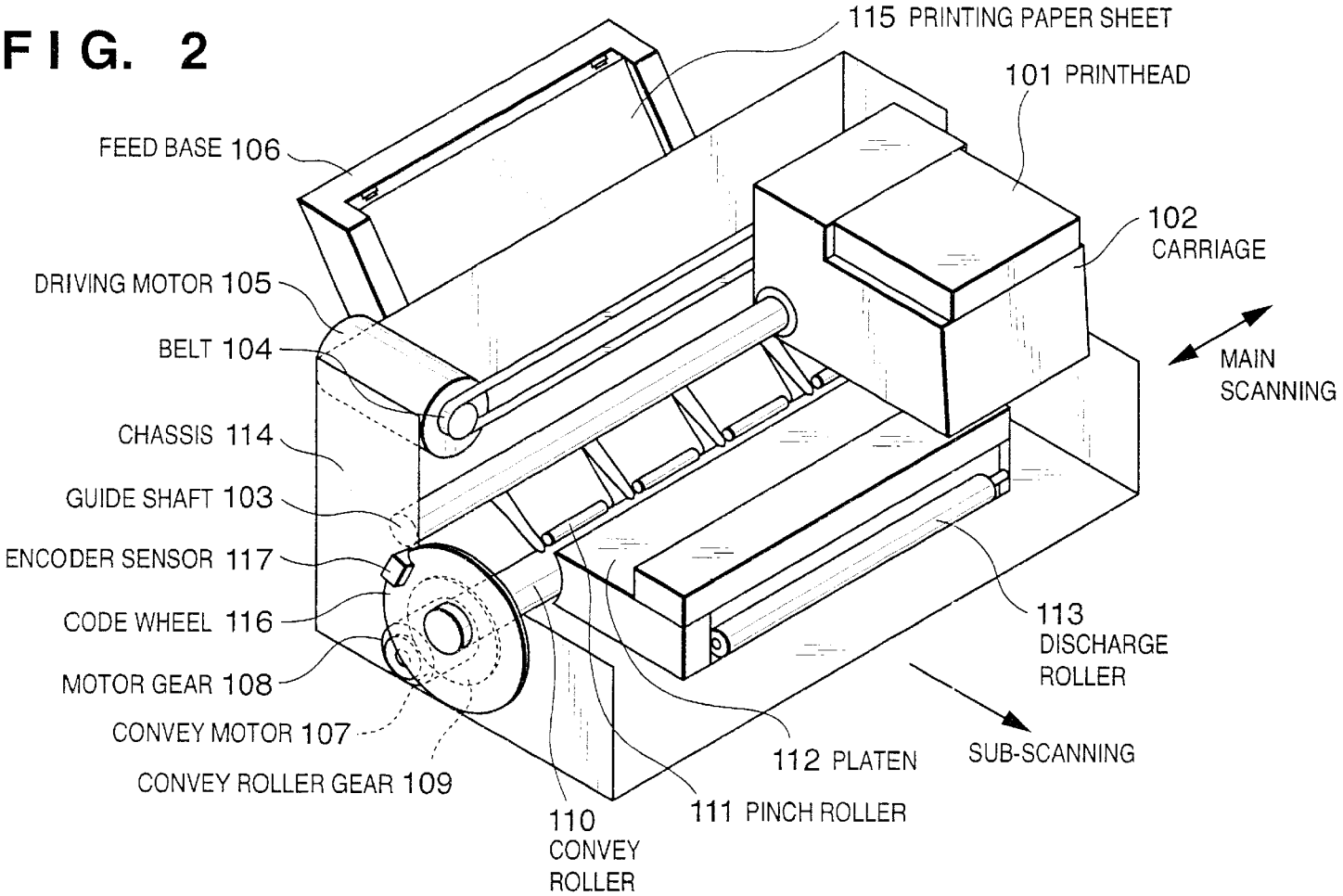
FIG. 2 is a perspective view showing the overall arrangement of a serial inkjet printer.

FIG. 2 is a perspective view showing the overall arrangement of the serial inkjet printer. Referring to FIG. 2, a printhead 101 has an ink tank. The printhead 101 is mounted on a carriage 102. A guide shaft 103 is inserted to the bearing portion of the carriage 102 so as to be slidable in the main scanning direction. The two ends of the shaft are fixed to a chassis 114. A driving motor 105 serving as a carriage driving means transmits driving power through a belt 104 serving as a carriage drive transmission means engaged with the carriage 102 so that the carriage 102 can move in the main scanning direction.

In a printing standby state, printing paper sheets 115 are stacked on a feed base 106. At the start of printing, a printing paper sheet is fed by a feed roller (not shown). To convey the fed printing paper sheet, a convey roller is rotated by the driving force of a paper convey motor (107), i.e., a DC motor through a gear train (motor gear 108 and convey roller gear 109) serving as a transmission means. The printing paper sheet 115 is conveyed by an appropriate feed amount by a convey roller 110 and pinch rollers 111 that are pressed by the convey roller 110 and makes follow-up rotation. The convey amount is managed by detecting and counting, with an encoder sensor 117, slits of a code wheel (rotary encoder film 116) pressed and fitted into the convey roller gear 109. Hence, accurate feeding is possible.

Figure 3:
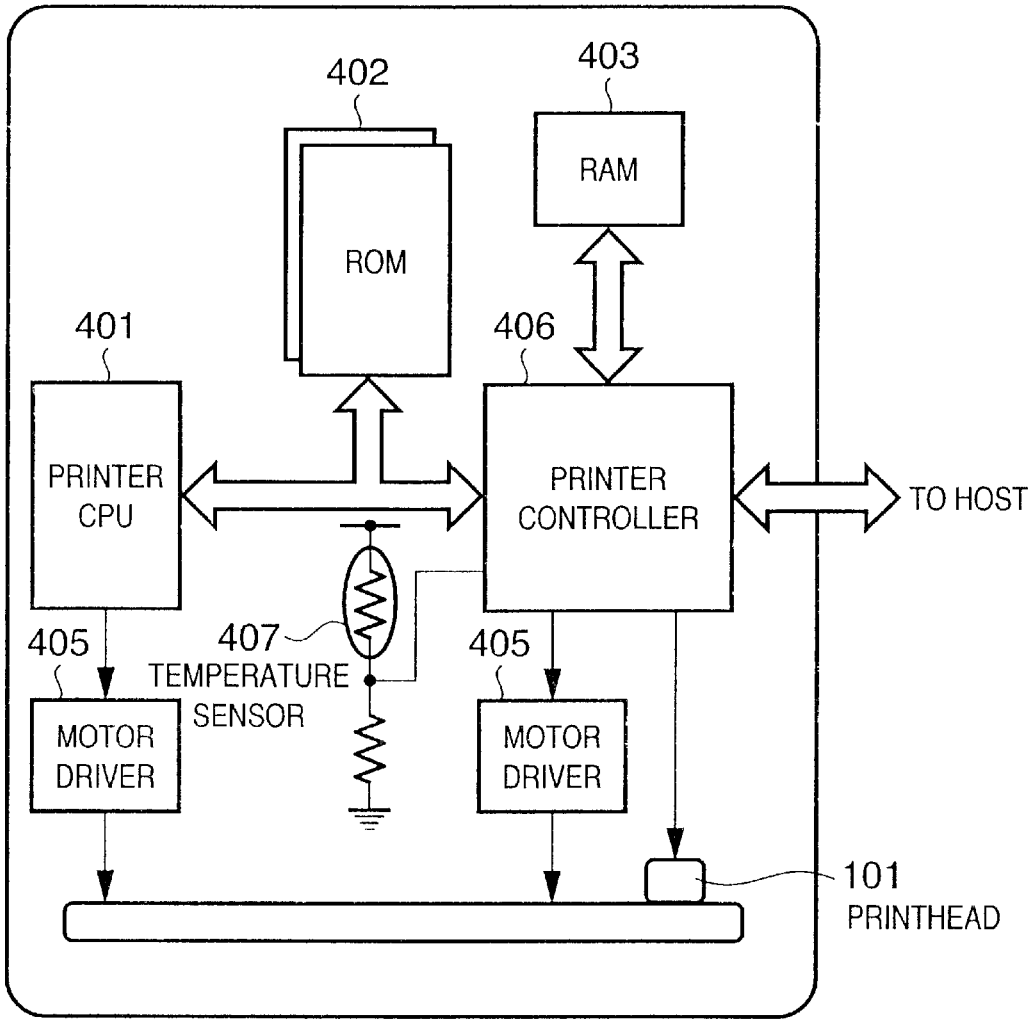
FIG. 3 is a block diagram for explaining the control arrangement of the printer.

FIG. 3 is a block diagram for explaining the control arrangement of the printer shown in FIG. 2.

Referring to FIG. 3, reference numeral 401 denotes a CPU for controlling the printer of the printer apparatus. The CPU 401 controls printing processing using a printer control program stored in a ROM 402 or printer emulation and print fonts.

A RAM 403 stores rasterized data for printing or received data from a host. Reference numeral 404 denotes a printer head; and 405, a motor driver. A printer controller 406 controls access to the RAM 403, exchanges data with the host apparatus, and sends a control signal to the motor driver. A temperature sensor 407 formed from a thermistor or the like detects the temperature of the printer apparatus.

The CPU 401 reads out from the I/O data register in the printer controller 406 information such as an emulation command sent from the host apparatus to the printer apparatus and writes/reads control corresponding to the command in/from the I/O register and I/O port in the printer controller 406, while mechanically and electrically controlling the main body in accordance with the control program in the ROM 402.

Figure 4:
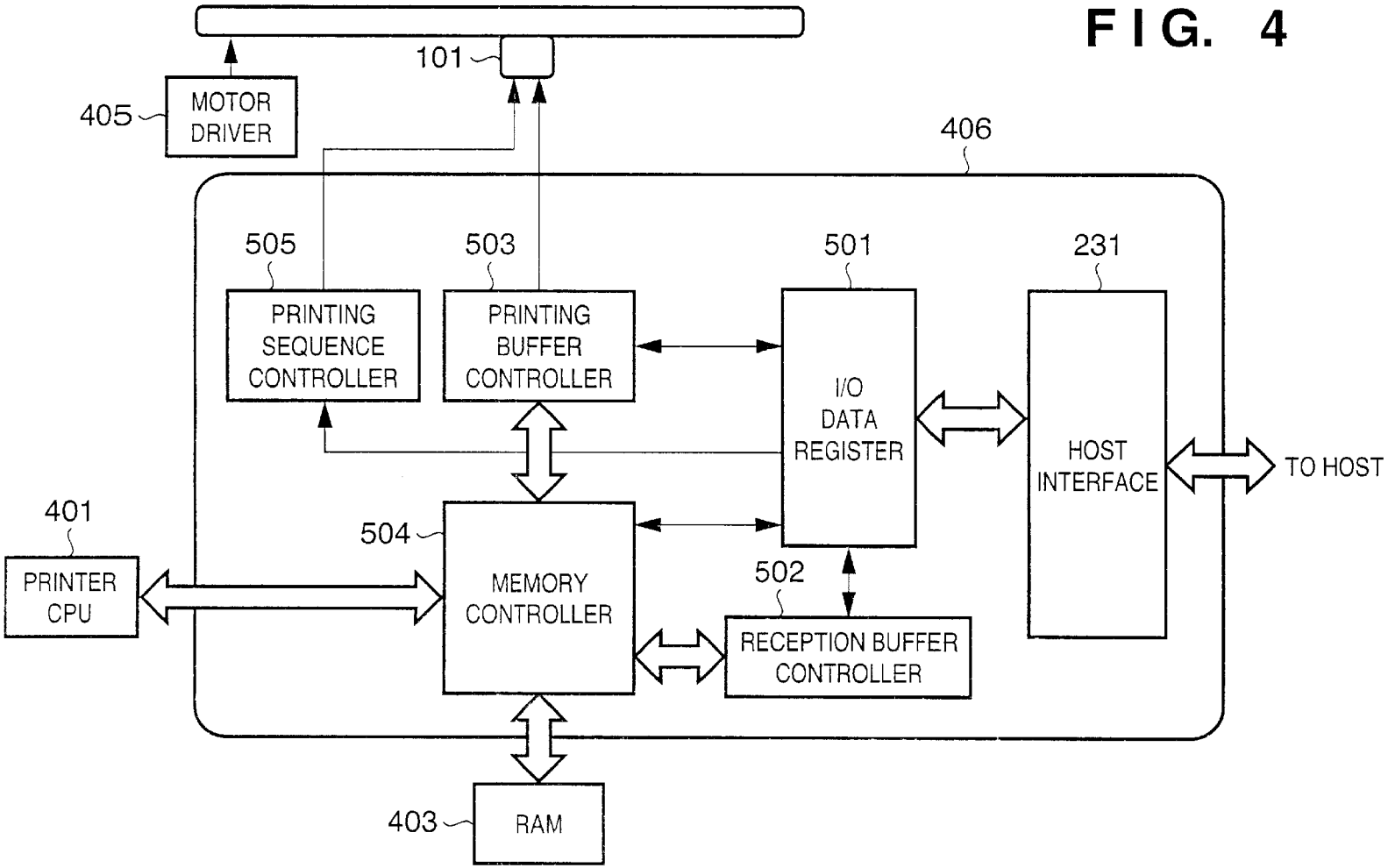
FIG. 4 is a block diagram for explaining the detailed arrangement of a printer controller.

FIG. 4 is a block diagram for explaining the detailed arrangement of the printer controller 406 shown in FIG. 3. The same reference numerals as in FIG. 3 denote the same parts in FIG. 4.

Referring to FIG. 4, an I/O register 501 exchanges data with the host at the command level. A reception buffer controller 502 directly writes received data from the register in the RAM 403.

In printing, a printing buffer controller 503 reads out print data from the print data buffer of the RAM and sends the data to the printer head 404. A memory controller 504 controls three-directional memory access with respect to the RAM 403. A printing sequence controller 505 controls a printing sequence. A host interface 231 communicates with the host.

Figure 5:
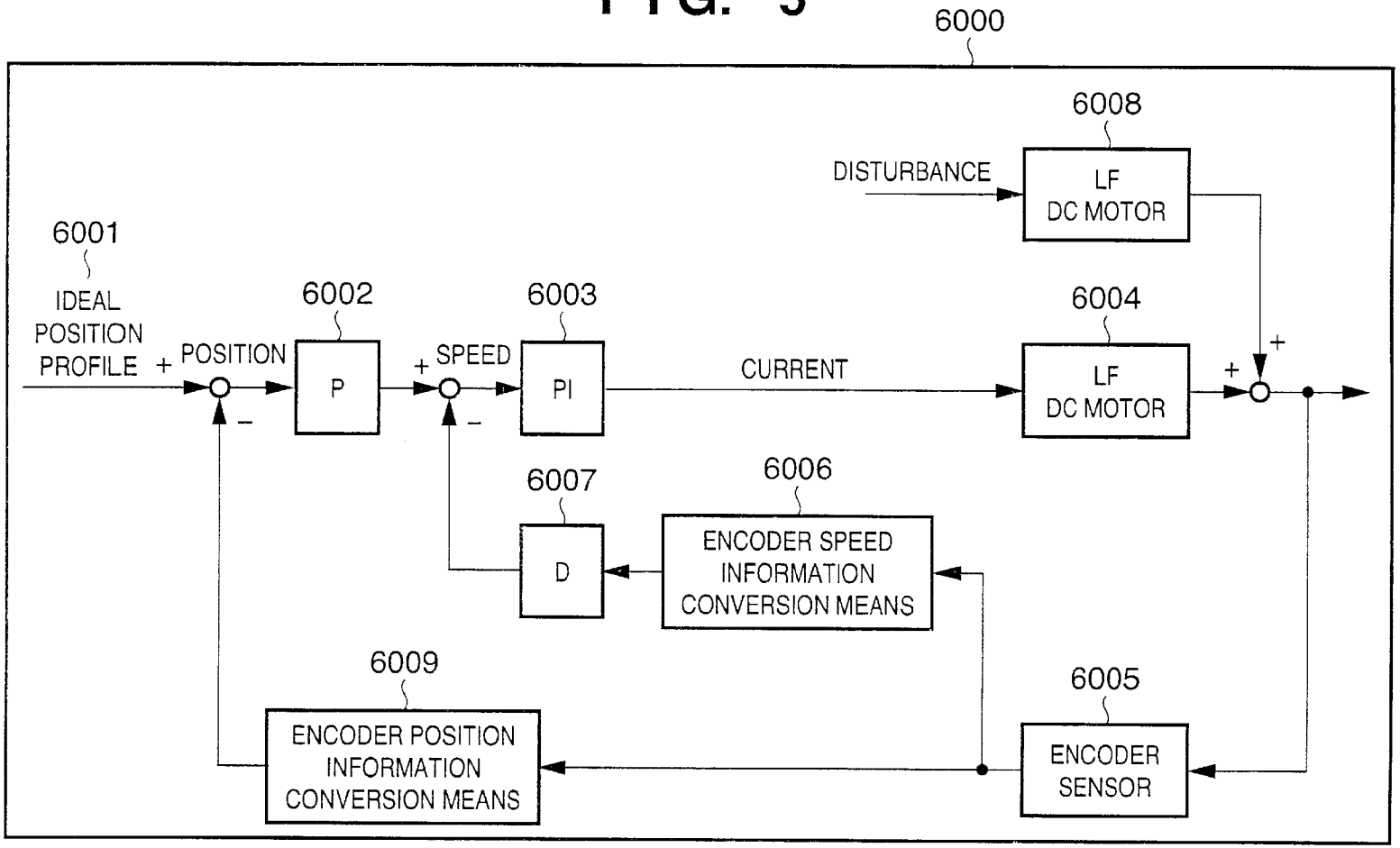
FIG. 5 is a schematic view for explaining the position control system of a general DC motor so as to explain a method for position servo.

FIG. 5 is a block diagram showing a control procedure (6000) so as to explain the position control system of a general DC motor. In this embodiment, position servo is used in the acceleration control region, constant speed control region, and deceleration control region. Such DC motor control is done by a method called PID control or classic control. The procedure will be described below.

A target position to be given to a control object is given by an ideal position profile 6001. In this embodiment, the target position corresponds to an absolute position at which a paper sheet conveyed by the line feed motor should arrive at given time. This position information changes as the time elapses. When tracking control is executed for the ideal position profile, drive control of this embodiment is done.

The apparatus has an encoder sensor 6005 to detect the physical rotation of the motor. An encoder position information conversion means 6009 obtains absolute position information by cumulatively adding the number of slits detected by the encoder sensor. An encoder speed information conversion means 6006 calculates the current driving speed of the line feed motor from the signal from the encoder sensor 6005 and a clock (timer) incorporated in the printer.

A numerical value obtained by subtracting the actual physical position obtained by the position information conversion means 6009 from the ideal position profile 6001 is transferred to feedback processing of position servo from a circuit 6002. The circuit 6002 is the major loop of position servo. Generally, a means for executing calculation related to a proportional term P is known.

As an arithmetic result of the circuit 6002, a speed command value is output. This speed command value is transferred to feedback processing of speed servo from a circuit 6003. As the minor loop of speed servo, a means for executing PID arithmetic operation for the proportional term P, integral term I, and derivative term D is generally used.

In this embodiment, to improve the followability when the speed command value has nonlinearly changed and also to prevent any influence of derivative operation in tracking control, a method generally called D-PI is shown. The encoder speed information obtained by the encoder speed information conversion means 6006 is passed through a derivative operation circuit 6007 before calculating the difference between it and the speed command value obtained by the circuit 6002. This method itself is irrelevant to the present invention. Derivative operation by the circuit 6003 sometimes suffices depending on the characteristics of the system to be controlled.

In the minor loop of speed servo, a numerical value obtained by subtracting encoder speed information from the speed command value is transferred to the PI arithmetic circuit 6003 as a speed error that is short of the target speed. An energy to be applied to the DC motor at that time is calculated by a method called PI arithmetic operation. Upon receiving the energy, the motor driver circuit changes the duty of the applied voltage using, e.g., a means (to be referred to as "PWM (Pulse Width Modulation) control" hereinafter) for changing the pulse width of the applied voltage while keeping the motor applied voltage unchanged. With this operation, the current value is adjusted, and the energy to be applied to a DC motor 6004 is adjusted, thereby controlling the speed.

The DC motor which rotates upon receiving the current value physically rotates while being influenced by the disturbance of a DC motor 6008. The output of the DC motor is detected by the encoder sensor 6005.

Figure 6:
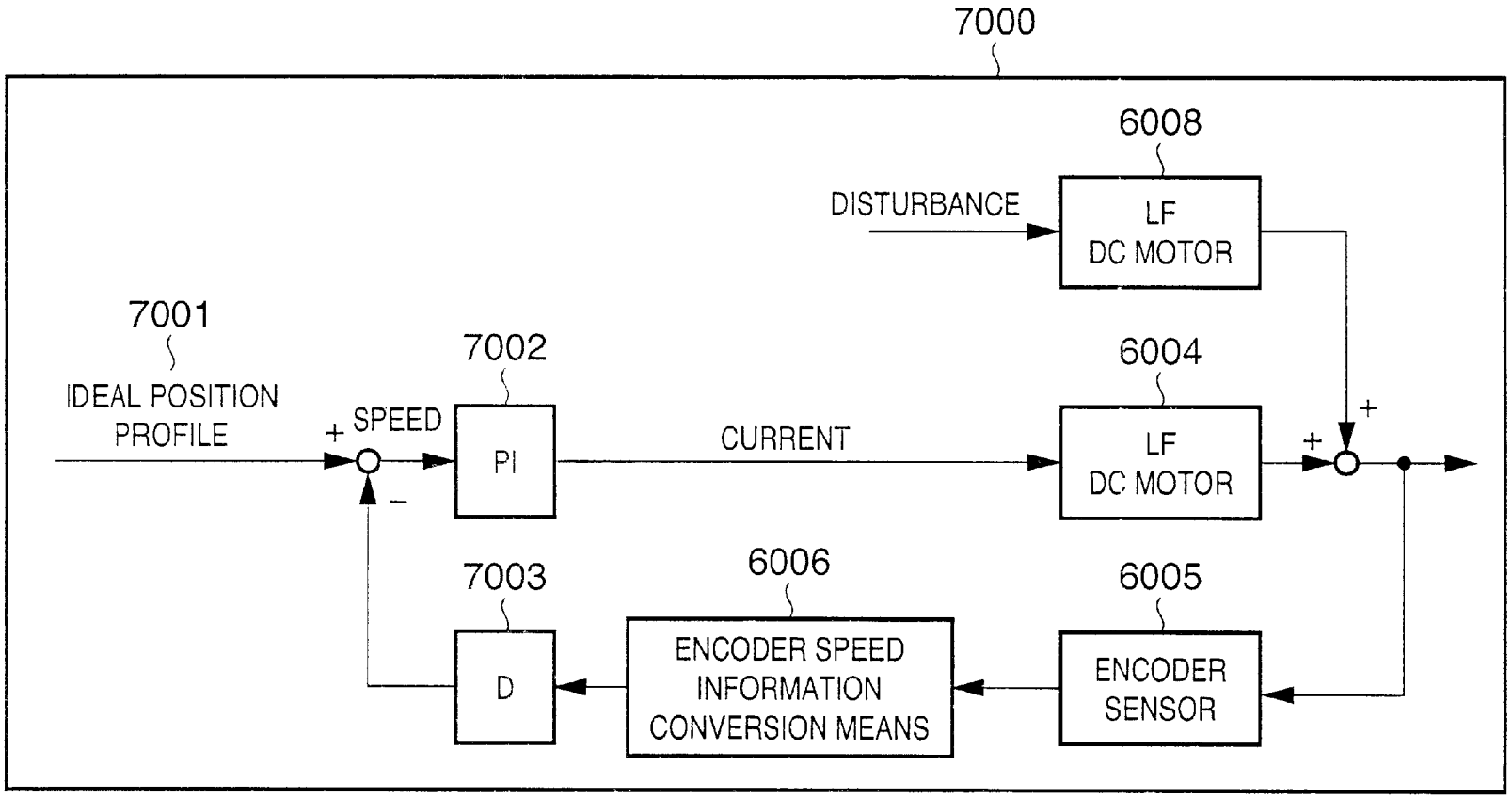
FIG. 6 is a schematic view for explaining the speed control system of a general DC motor so as to explain a method for speed servo.

FIG. 6 is a block diagram for explaining a control procedure (7000) in speed servo of the general DC motor. In this embodiment, speed servo is used in the positioning control region. The DC motor is controlled by a method called PID control or classic control. The procedure will be described below.

A target speed to be given to a control object is given by an ideal speed profile 7001. In this embodiment, the target speed corresponds to an ideal speed at which a paper sheet should be conveyed by the line feed motor at given time. The target speed corresponds to a speed command value at the given time. This speed information changes as the time elapses. When tracking control is executed for the ideal speed profile, drive control of this embodiment is done.

In speed servo, a means for executing PID arithmetic operation for the proportional term P, integral term I, and derivative term D is generally used. In this embodiment, to improve the followability when the speed command value has nonlinearly changed and also to prevent any influence of derivative operation in tracking control, a method generally called D-PI is shown. The encoder speed information obtained by the encoder speed information conversion means 6006 is passed through a derivative operation means 7003 before calculating the difference between it and the speed command value obtained by the circuit 7001. This method itself is irrelevant to the present invention. Derivative operation by a circuit 7002 sometimes suffices depending on the characteristics of the system to be controlled.

In speed servo, a numerical value obtained by subtracting encoder speed information from the speed command value is transferred to the PI arithmetic circuit 7002 as a speed error that is short of the target speed. An energy to be applied to the DC motor at that time is calculated by a method called PI arithmetic operation. Upon receiving the energy, the motor driver circuit changes the duty of the applied voltage using, e.g., PWM control. With this operation, the current value is adjusted, and the energy to be applied to the DC motor 6004 is adjusted, thereby controlling the speed.

The DC motor which rotates upon receiving the current value physically rotates while being influenced by the disturbance of the DC motor 6008. The output of the DC motor is detected by the encoder sensor 6005.

Figure 7:
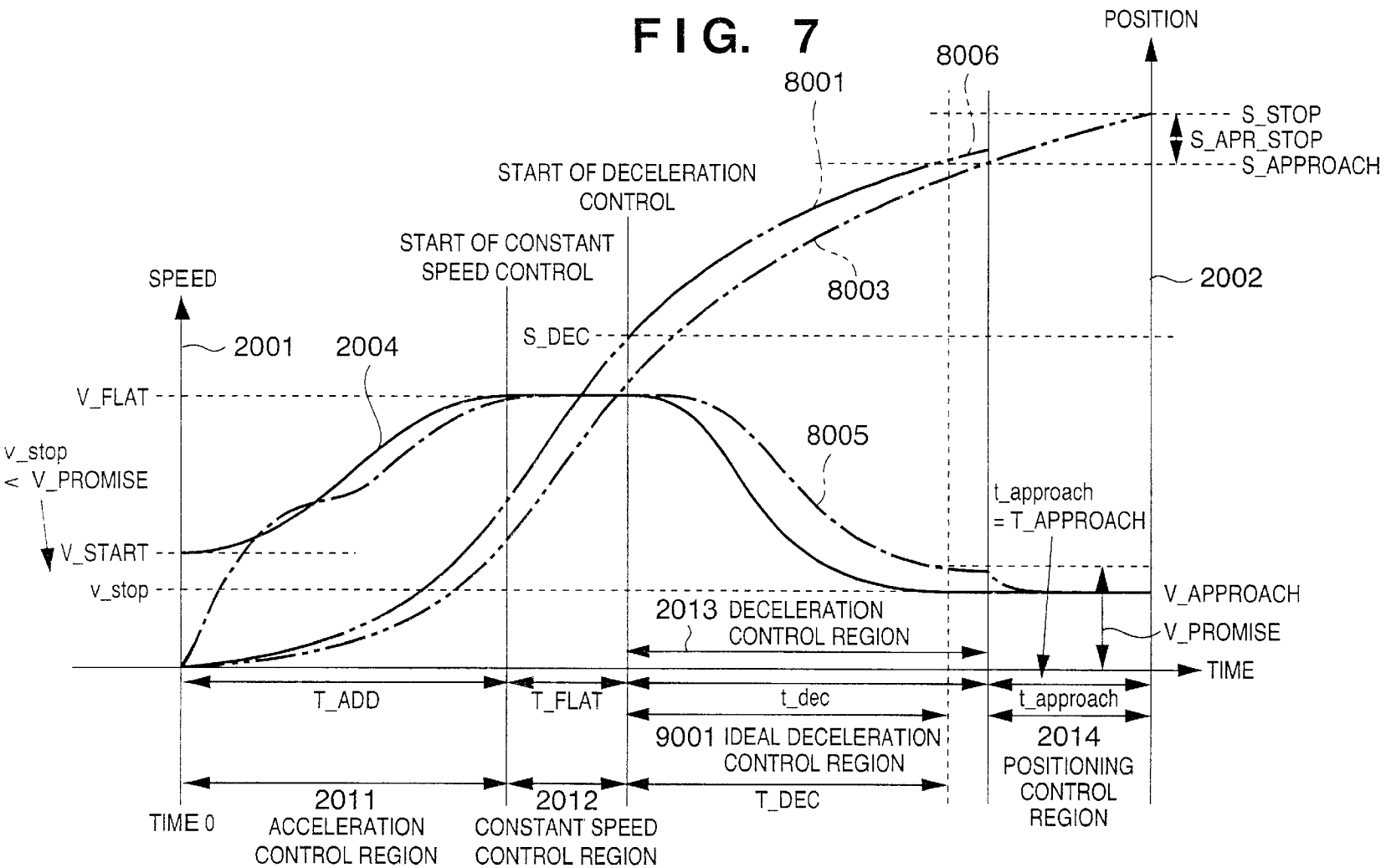
FIG. 7 is a timing chart for explaining the influence of disturbance and actual control in detail.
Figure 8:
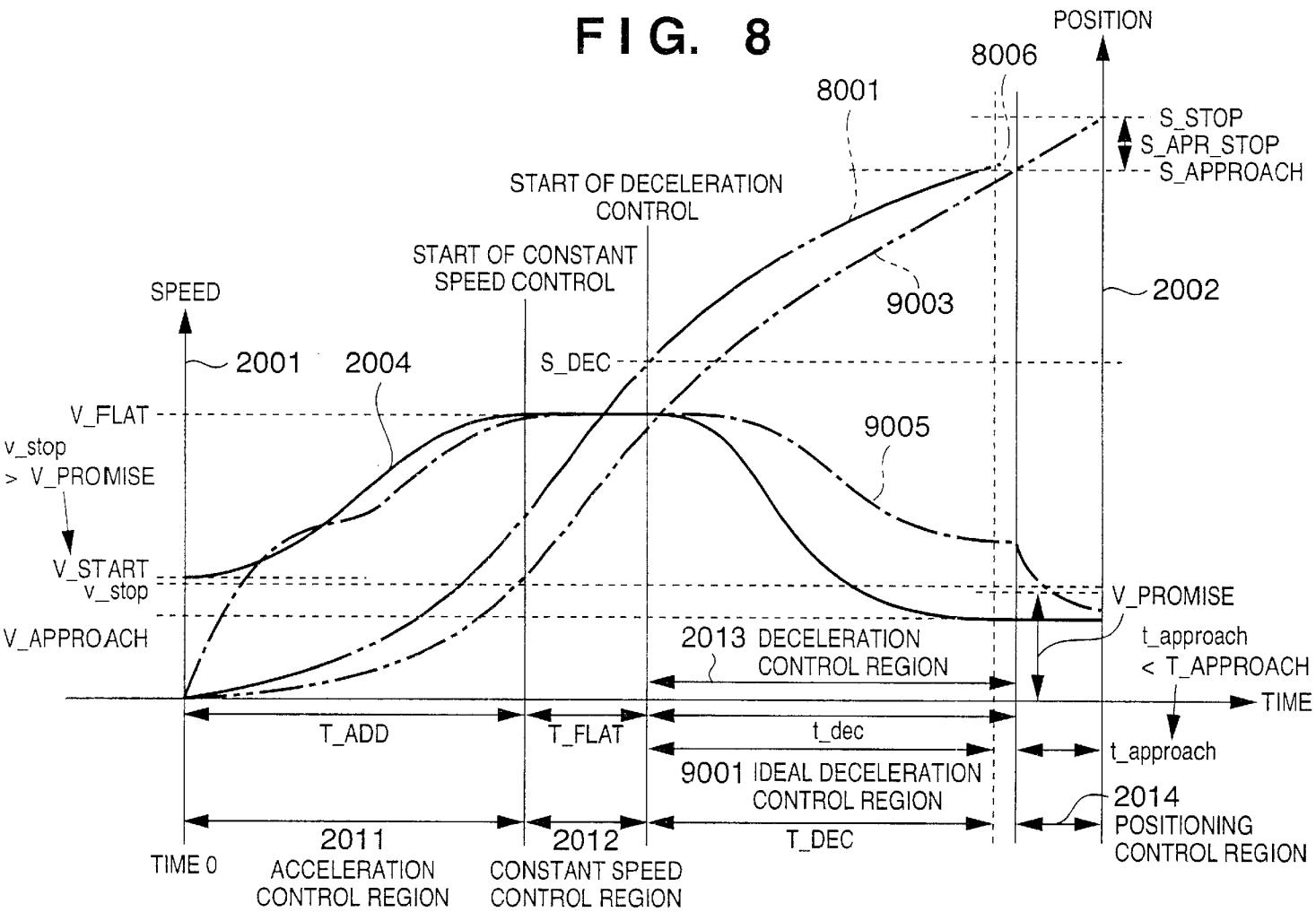
FIG. 8 is a timing chart for explaining the influence of disturbance and actual control in detail.
Figure 9:
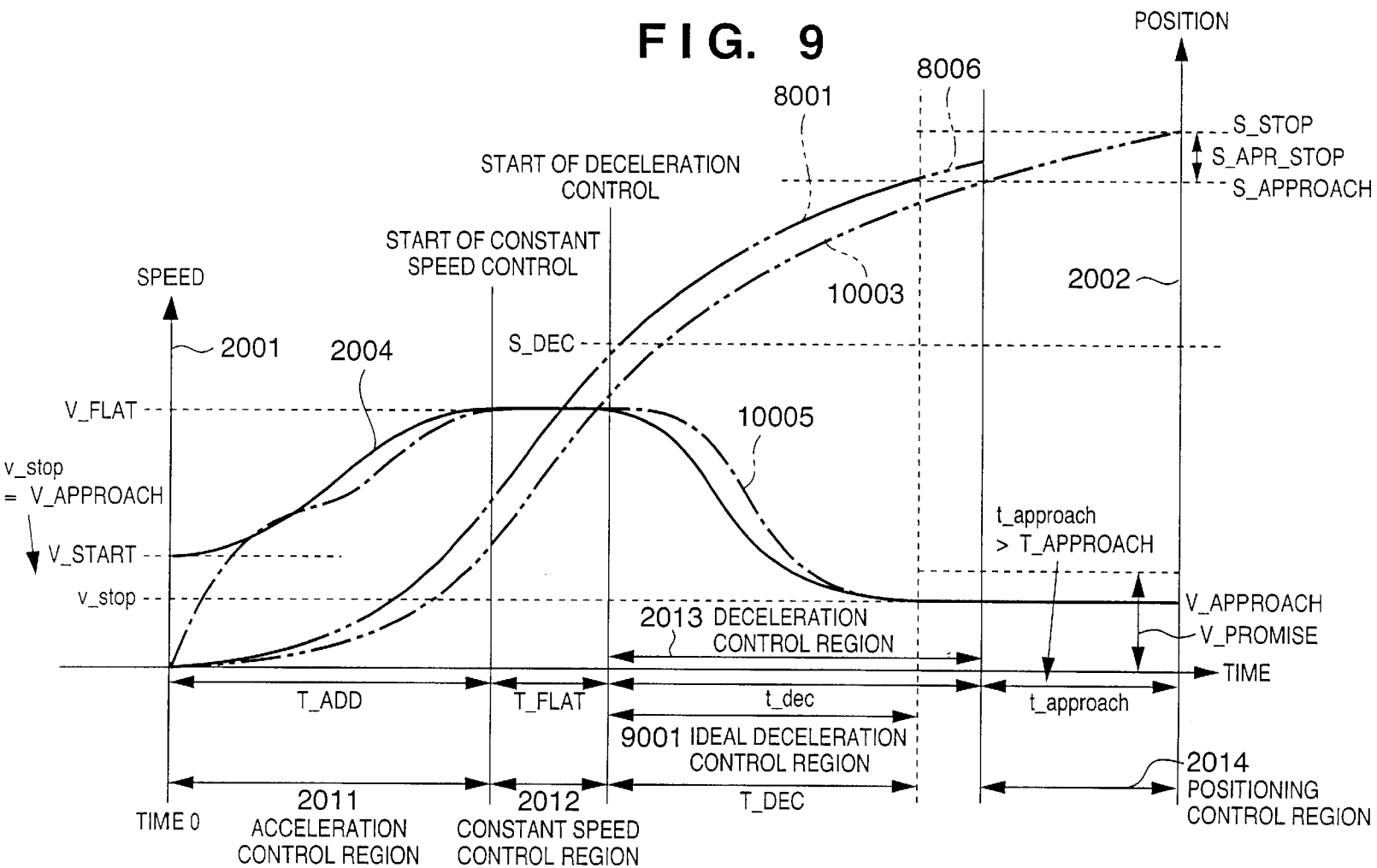
FIG. 9 is a timing chart for explaining the influence of disturbance and actual control in detail.

FIGS. 7, 8, and 9 explain in detail the influence of disturbance and actual control in sub-scanning direction control of this embodiment. The abscissa represents the time. An ordinate 2001 represents the speed, and an ordinate 2002 represents the position.

FIG. 7 shows a case wherein a speed v_stop immediately before stop ends at an average and ideal value V_APPROACH. FIG. 8 shows a case wherein t_approach<T_APPROACH, i.e., the speed v_stop immediately before stop ends before the expected time. FIG. 9 shows a case wherein t_approach>T_APPROACH, i.e., the speed v_stop immediately before stop ends after the expected time.

Reference numeral 8001 denotes an ideal position profile; and 2004, an ideal speed profile. The ideal position profile 8001 is formed from four control regions: an acceleration control region 2011, constant speed control region 2012, deceleration control region 2013, and positioning control region 2014.

In the ideal speed profile 2004, V_START denotes an initial speed; V_FLAT, a speed in the constant speed control region 2012; V_APPROACH, a speed in the positioning control region; and V_PROMISE, a highest speed value of the speed immediately before stop, which must always be kept to achieve the positioning accuracy performance. The speed v_stop immediately before stop is an actual value that changes to any value due to disturbance when actual driving is assumed. In consideration of a speed variation in actual driving, the value V_APPROACH must be set sufficient small such that the value v_stop does not exceed the value V_PROMISE for any variation in speed.

In this embodiment, position servo is employed in the acceleration control region 2011, constant speed control region 2012, and deceleration control region 2013. Speed servo is employed in the positioning control region 2014. The curve 8001 shown in FIGS. 7, 8, and 9 represents the ideal position profile in position servo. The curve 2004 shown in FIGS. 7, 8, and 9 represents the ideal speed profile in speed servo and the required speed profile obtained for follow-up operation to the ideal position profile in position servo.

The ideal position profile 8001 is set in the regions 2011, 2012, and 2013 for position servo, though it is calculated only until S_APPROACH. This is because the ideal position profile is unnecessary from S_APPROACH because control is switched to speed servo from S_APPROACH. A time T_DEC required for deceleration in the ideal position profile 8001 is constant independently of actual driving. A control region corresponding to the time T_DEC is indicated by an ideal deceleration control region 9001.

Reference numerals 8003, 9003, and 10003 denote actual position profiles in the situations of disturbance influence shown in FIGS. 7, 8, and 9. In position servo, since a delay always occurs, the actual position profiles 8003, 9003, and 10003 have delays with respect to the ideal position profile 8001. Hence, even when the ideal position profile 8001 is ended, the actual position does not reach S_APPROACH in general. In this embodiment, a virtual ideal position profile 8006 is used as the commanded position value to position servo after the ideal position profile 8001 is ended until actual driving reaches S_APPROACH. The virtual ideal position profile 8006 is indicated by a straight line extended from the end of the ideal position profile using the final gradient of the ideal position profile 8001.

Reference numerals 8005, 9005, and 10005 mean actual driving speed profiles of the physical motor. Using the ideal position profile 8001 as an input, feedback control is executed to make the speed closer to the ideal speed even with a slight delay from the ideal speed profile as the positioning control region 2014 comes close to the end, thereby settling the final speed immediately before stop to the speed V_APPROACH at which the positioning accuracy performance can be achieved. Note that the shift from the deceleration control region 2013 to the positioning control region 2014 is done at the moment when the speed has reached S_APPROACH independently of the physical driving speed state.

S_DEC represents a position at which the constant speed control region 2012 is ended and the deceleration control region 2013 starts. Since S_DEC is a value determined by the ideal position profile 8001, it has nothing to do with the influence of disturbance in actual driving.

S_APPROACH represents a position at which the deceleration control region 2013 is ended and the positioning control region 2014 starts. S_STOP represents a stop position.

T_ADD is a time required for the acceleration control region 2011. T_DEC is a time required for deceleration control region 2013. T_FLAT is a time required for the constant speed control region 2012. The time T_FLAT has a fixed value determined when the stop position S_STOP when the driving start position is defined as 0 is set, i.e., when the ideal position profile 8001 that satisfies the total driving distance is set. T_APPROACH is a time required for the positioning control region 2014. T_APPROACH is a time required for the object to be drive-controlled to move by a distance S_APR_STOP from the position S_APPROACH at which the positioning control region 2014 starts to the stop position S_STOP in actual movement. FIG. 7 shows a case wherein the object to be drive-controlled has almost ideally moved through the positioning region. In actual control, the ideal physical operation is generally very difficult.

For high-speed accurate positioning, the curve of the ideal position profile 8001 must be tuned in accordance with the system. More specifically, the ideal position profile 8001 is preferably set such that the speed in the constant speed control region 2012 becomes as high as possible to improve the positioning required time performance so far as the system performance permits, the speed in the positioning control region 2014 becomes as low as possible to improve the positioning accuracy performance so far as the system performance permits, and the lengths of the acceleration control region 2011, deceleration control region 2013, and positioning control region 2014 become as short as possible to improve the positioning required time performance so far as the system performance permits. However, a more detailed tuning method is irrelevant to the present invention. Here, a description will be made assuming that the ideal position profile 8001 has already been optimized.

A value t_approach is the actual variable value of the time required for the positioning control region 2014 as the actual value that changes to any value due to disturbance when actual driving is assumed (In this embodiment, a constant value is indicated by upper-case letters, and a variable value is indicated by lower-case letters. When values with the same spelling are represented by both upper- and lower-case letters, the value indicated by upper-case letters represents an ideal constant value, and the value indicated by lower-case letters represents a variable value that can change for the value with the same content).

Reference numerals 9005 and 10005 mean the actual driving speed profiles of the physical motor. From a broader viewpoint, they indicate acceleration/deceleration profiles like the ideal driving actual speed profile 8005. However, because of disturbance, at the start of the positioning control region 2014, the speed is high in the profile 9005 and low in the profile 10005.

Due to this influence, the average speed in the positioning control region 2014 becomes high in the profile 9005. As a result, the time actually required to pass through the positioning control region 2014 is shorter than T_APPROACH, and the time required for control is shortened.

In addition, the average speed in the positioning control region 2014 becomes low in the profile 10005. As a result, the time actually required to pass through the positioning control region 2014 is longer than T_APPROACH, and the time required for control is prolonged.

Figure 10:
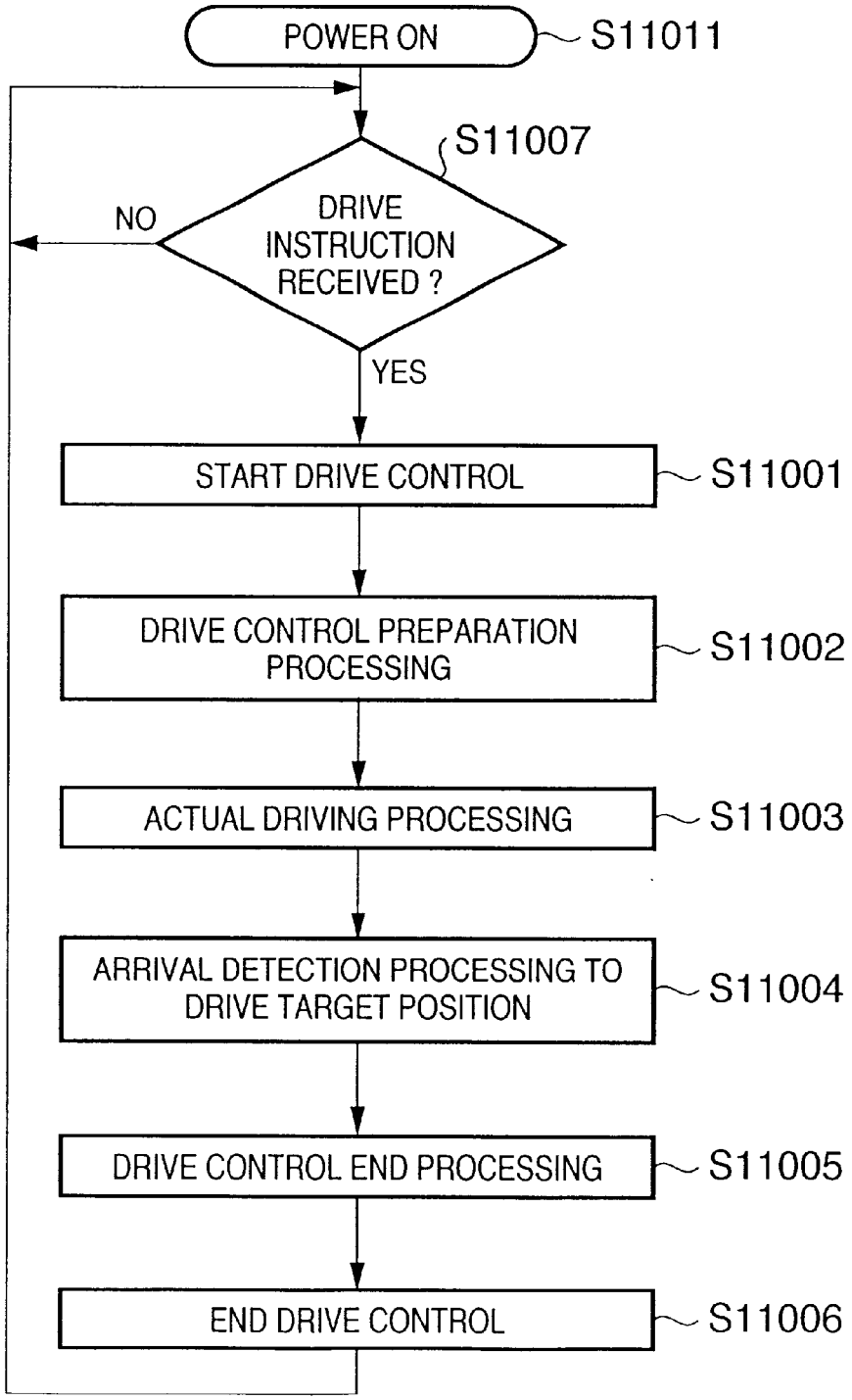
FIG. 10 is a flow chart for explaining the flow of general driving processing.
Figure 11:
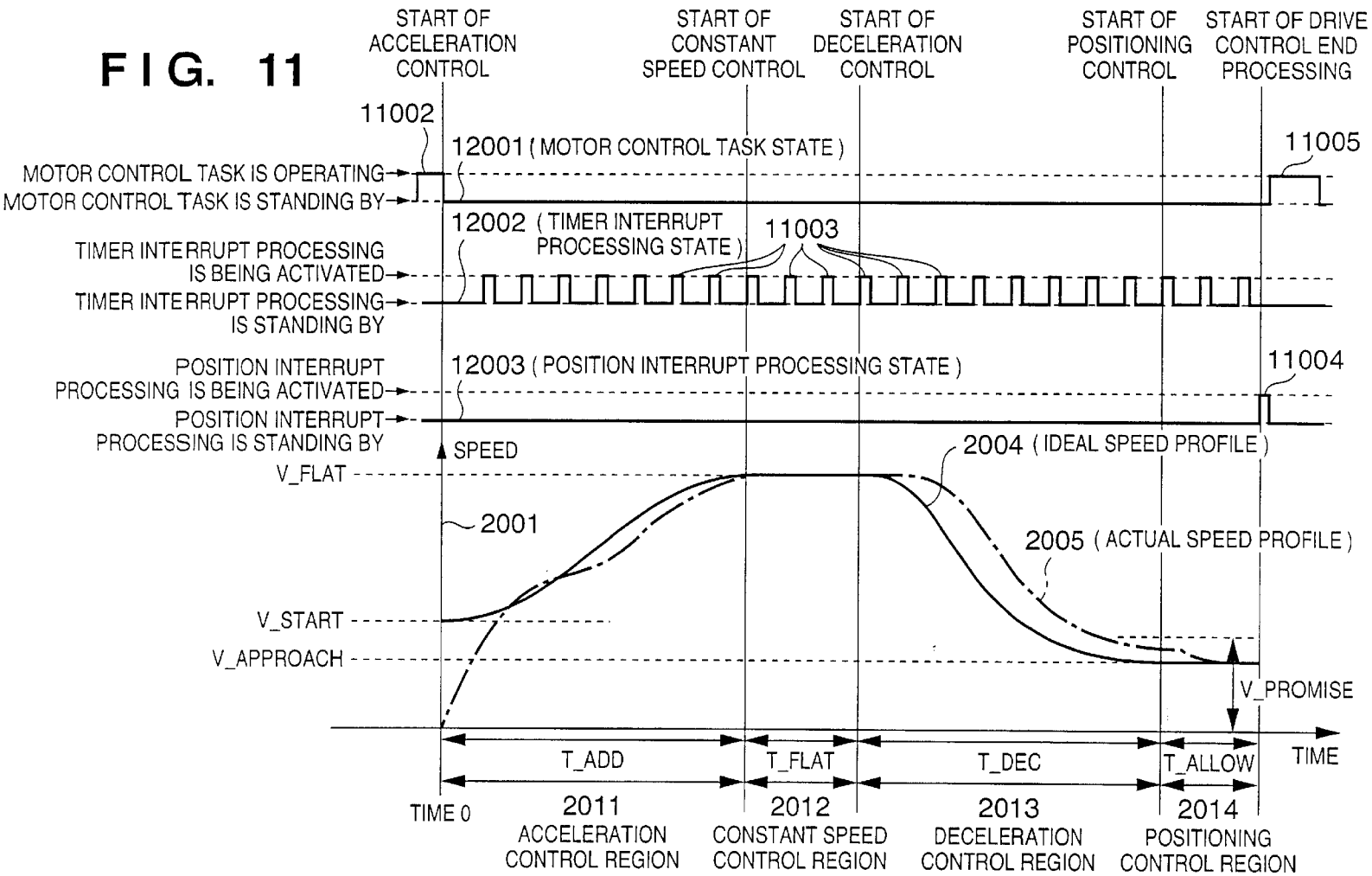
FIG. 11 is a timing chart related to each processing described in FIG. 10.

FIG. 10 is a flow chart for explaining the flow of driving processing of this embodiment. FIG. 11 is a timing chart related to each processing described in FIG. 10.

In step S11011, the system is powered on. In step S11007, it is determined whether a drive instruction is received. When a drive instruction is received (S11007-YES), i.e., a drive instruction is issued in the printer system, the processing advances to step S11001.

When drive control processing starts in step S11001, drive control preparation is done in step S11002. Preparation processing in step S11002 is generally described in the motor control task. In this processing, a table appropriate to the drive purpose is selected, T_FLAT that matches the drive amount is set, and a reflection means which reflects a result of an evaluation means on the ideal speed profile to be used for the next driving as the gist of the present invention and various work regions are set. Finally, a timer which controls timer interrupt processing is activated, and the preparation is ended.

When the timer is activated in step S11002, the flow advances to actual driving processing (S11003). Step S11003 is processing that is generally described in timer interrupt processing. For example, an interrupt is executed every msec to read the value of the encoder, calculate by PID arithmetic operation or the like the current value to be output, and output the value to the motor.

In parallel to the processing in step S11003, it is monitored in the system whether the position has arrived at the stop position S_STOP. When the arrival is detected, an arrival detection means 11004 to the drive target position operates to generate an interrupt. The processing advances to a drive control end means 11005.

In step S11005, after the output to the motor is quickly disabled, the timer is stopped, and the processing is ended.

Referring to FIG. 11, reference numeral 12001 denotes a state of the motor drive task in steps S11002 and S11005 in FIG. 10; 12002, a state of the timer interrupt processing in step S11003; and 12003, a state of a position interrupt in step S11004.

With the above processing operations, one driving processing cycle reaches drive control end in step S11006.

Figure 12:
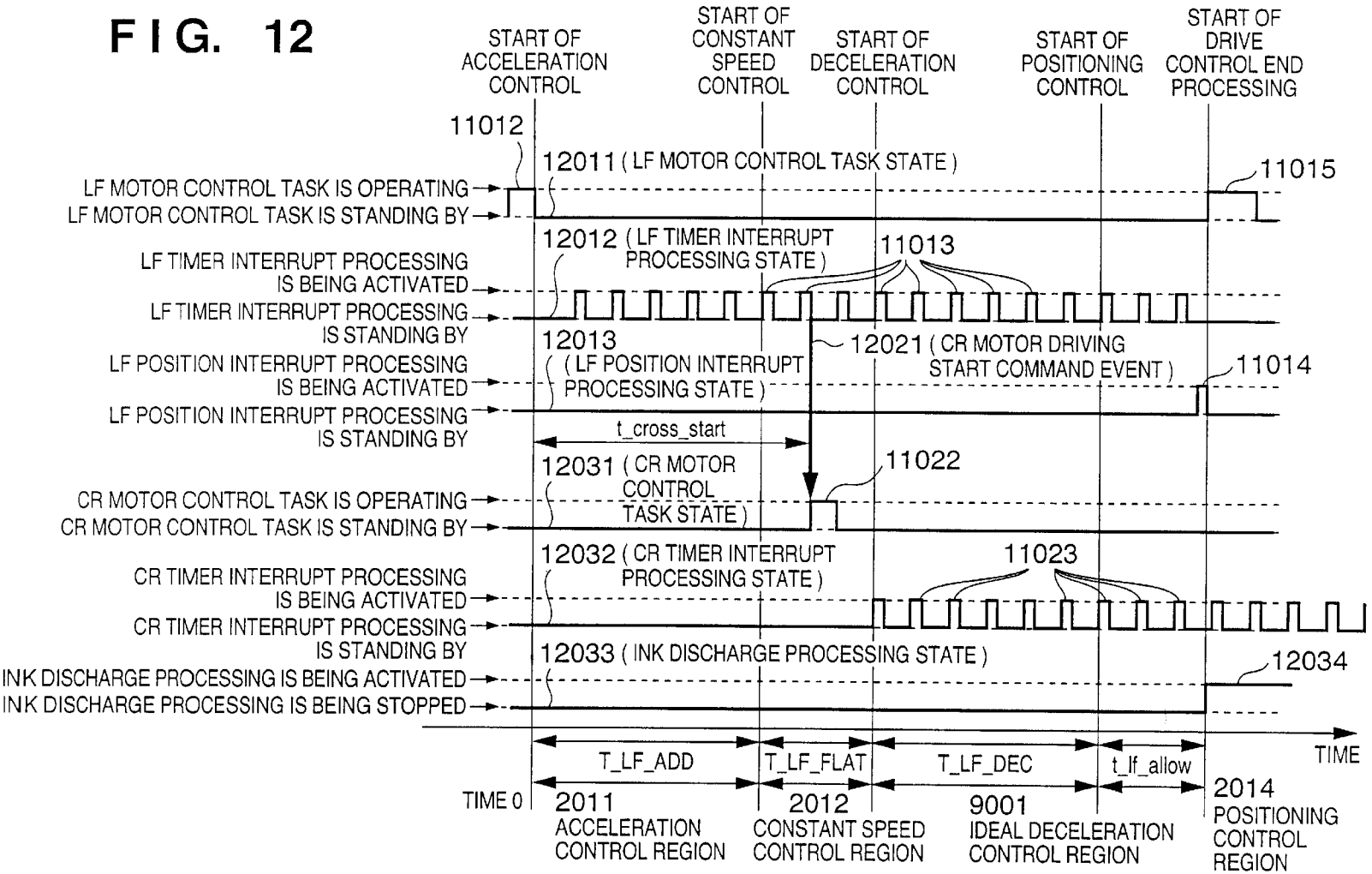
FIG. 12 is a timing chart for explaining timing management when the general driving processing flow is applied to sub-scanning (LF) and main scanning (CR)

FIG. 12 is a timing chart showing timing management when the above-described general driving processing flow is applied to sub-scanning (LF) and main scanning (CR).

Referring to FIG. 12, reference numeral 11012 denotes a sub-scanning drive control preparation signal; and 11022, a main scanning drive control preparation signal. Both signals execute the same processing as in 11002 (FIG. 11) in the general driving processing for the motors to be driven.

Reference numeral 11013 denotes a signal used to execute sub-scanning actual driving processing; and 11023, a signal used to execute main scanning actual driving processing. Both signals execute the same processing as in 11003 (FIG. 11) in the general driving processing for the motors to be driven.

Reference numeral 11014 denotes an arrival detection signal to the drive target position in sub-scanning. This signal executes, in sub-scanning, the same processing as in 11004 (FIG. 11) in the general driving processing. Reference numeral 11015 denotes a drive control end signal in sub-scanning. This signal executes, in sub-scanning, the same processing as in 11005 (FIG. 11) in the general driving processing.

Reference numeral 12011 denotes a motor control task state related to sub-scanning; and 12031, a motor control task state related to main scanning. They describe the same contents as in 12001 (FIG. 11) in the general driving processing for sub-scanning and main scanning, respectively.

Reference numeral 12012 denotes an LF timer interrupt processing state; and 12032, a CR timer interrupt processing state. They describe the same contents as in 12002 (FIG. 11) in the general driving processing for sub-scanning and main scanning, respectively.

Reference numeral 12033 denotes an ink discharge processing state and indicates that discharge is being executed, i.e., printing is being executed in a region 12034.

To realize cross printing control, after the start of sub-scanning driving, when t_cross_start has elapsed, main scanning (CR) motor driving start command event 12021 is issued by a sub-scanning (LF) actual driving means for controlling the sub-scanning (LF) actual driving signal 11013. Upon receiving the event, the drive control preparation means activates the main scanning driving motor drive control signal 11022. When the thus activated main scanning motor has reached the printing start position, printing is executed in the region 12034. Referring to FIG. 12, since sub-scanning has already been stopped by the signal 11014 at that time, no skew printing occurs. In addition, since the ink discharge processing signal 12034 is activated immediately after the signal 11014, no wasteful processing time is present at all.

As is apparent from the above description, setting the optimum time t_cross_start is important in increasing the cross control efficiency. To set the optimum time t_cross_start, the actual time required for driving in the sub-scanning direction must be known. In FIG. 12, this time uniquely corresponds to an actual time t_lf_allow from the end of the ideal deceleration control region 9001 to the stop. This is because the time from the start of driving to the end of the ideal deceleration control region 9001 is given by a fixed value, and a variation in settling time by actual driving is represented only by the time t_lf_allow.

Figure 13B:
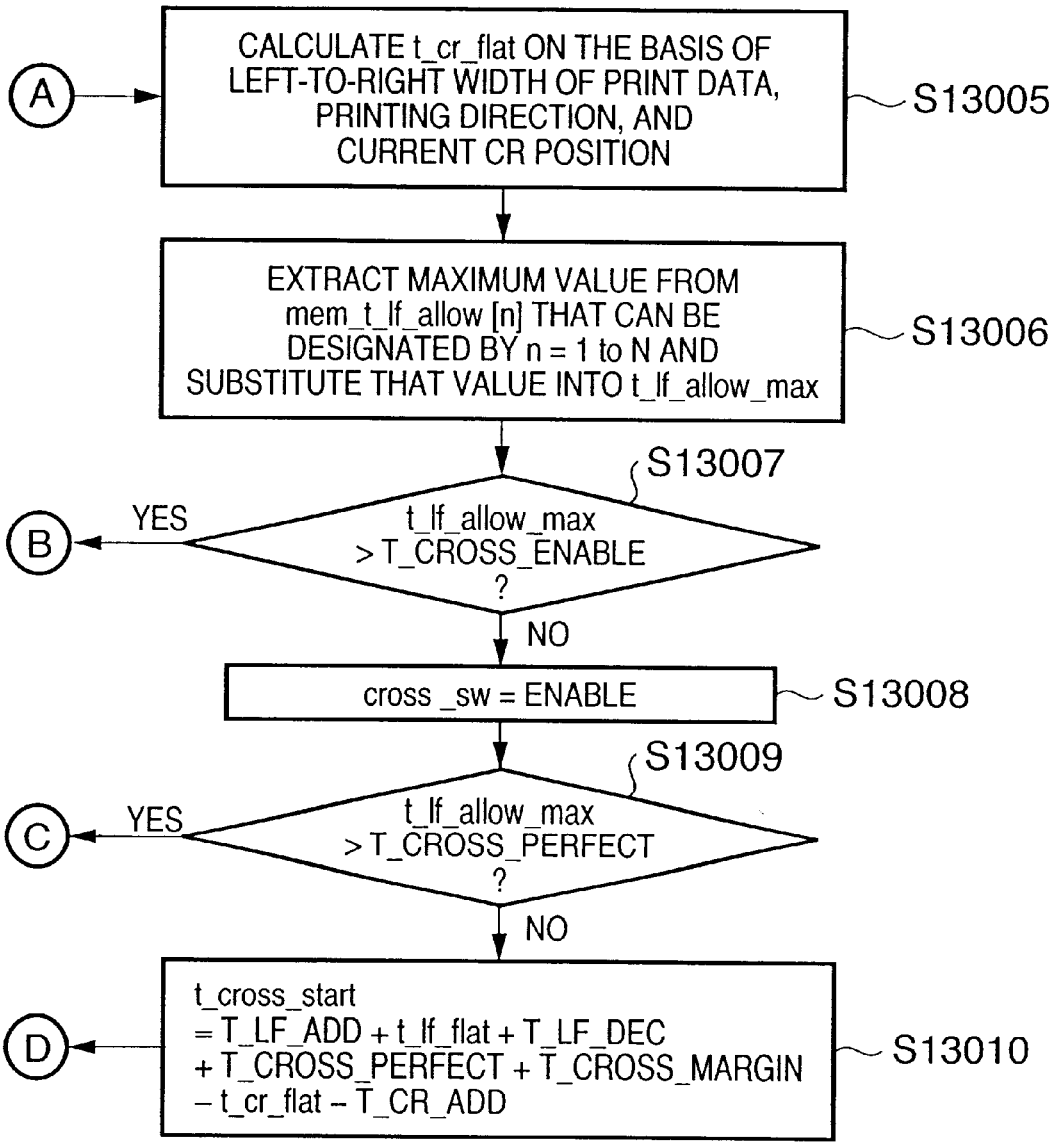

FIGS. 13A and 13B are flow charts showing processing as the gist of this embodiment in detail. FIGS. 14A, 14B, 15A, 15B, 16A, and 16B are timing charts directly showing the processing shown in the flow charts of FIGS. 13A and 13B.

Figures 14A, 14B:
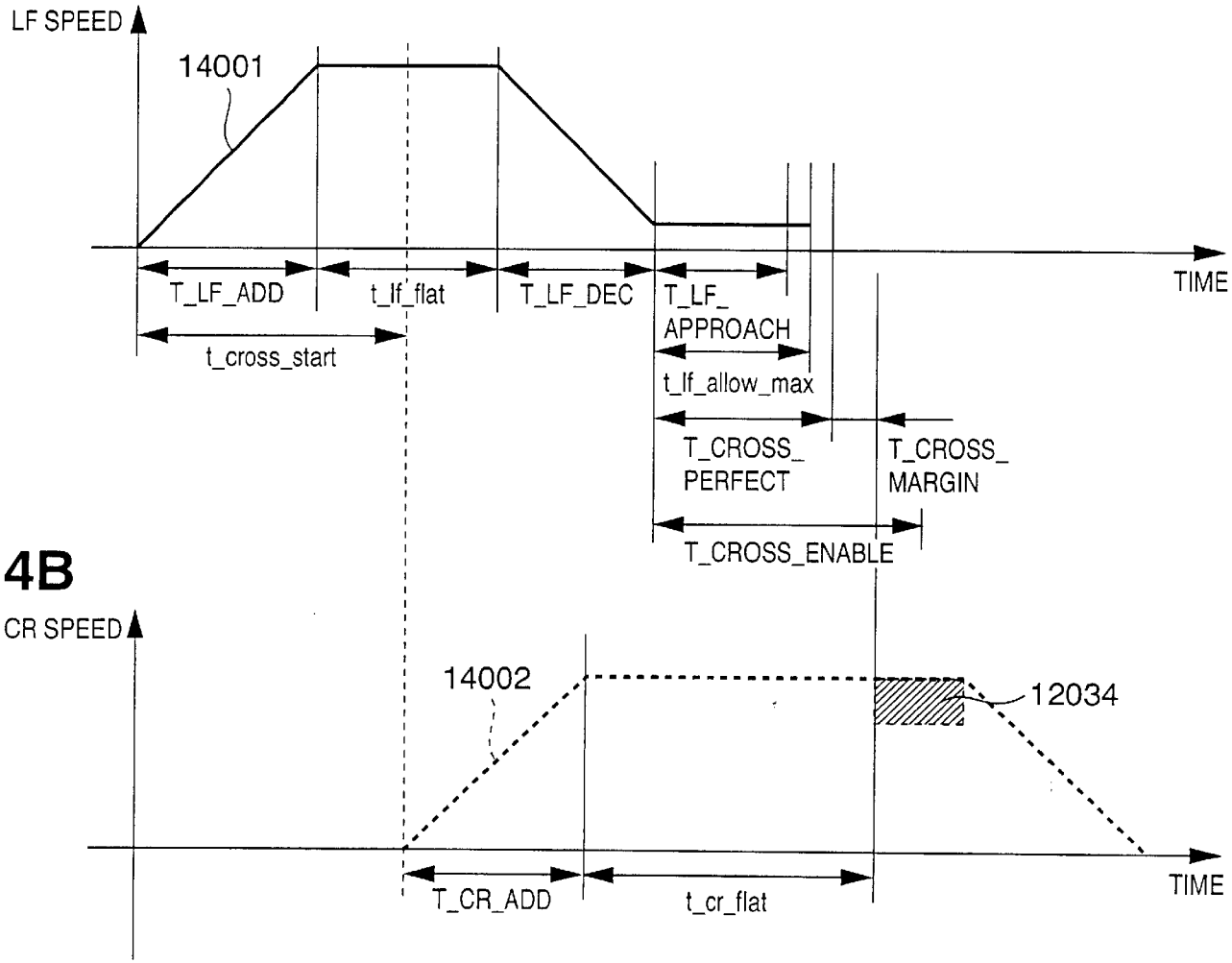
FIGS. 14A and 14B are timing charts related to processing according to the first embodiment of the present invention in detail.
Figures 15A, 15B:
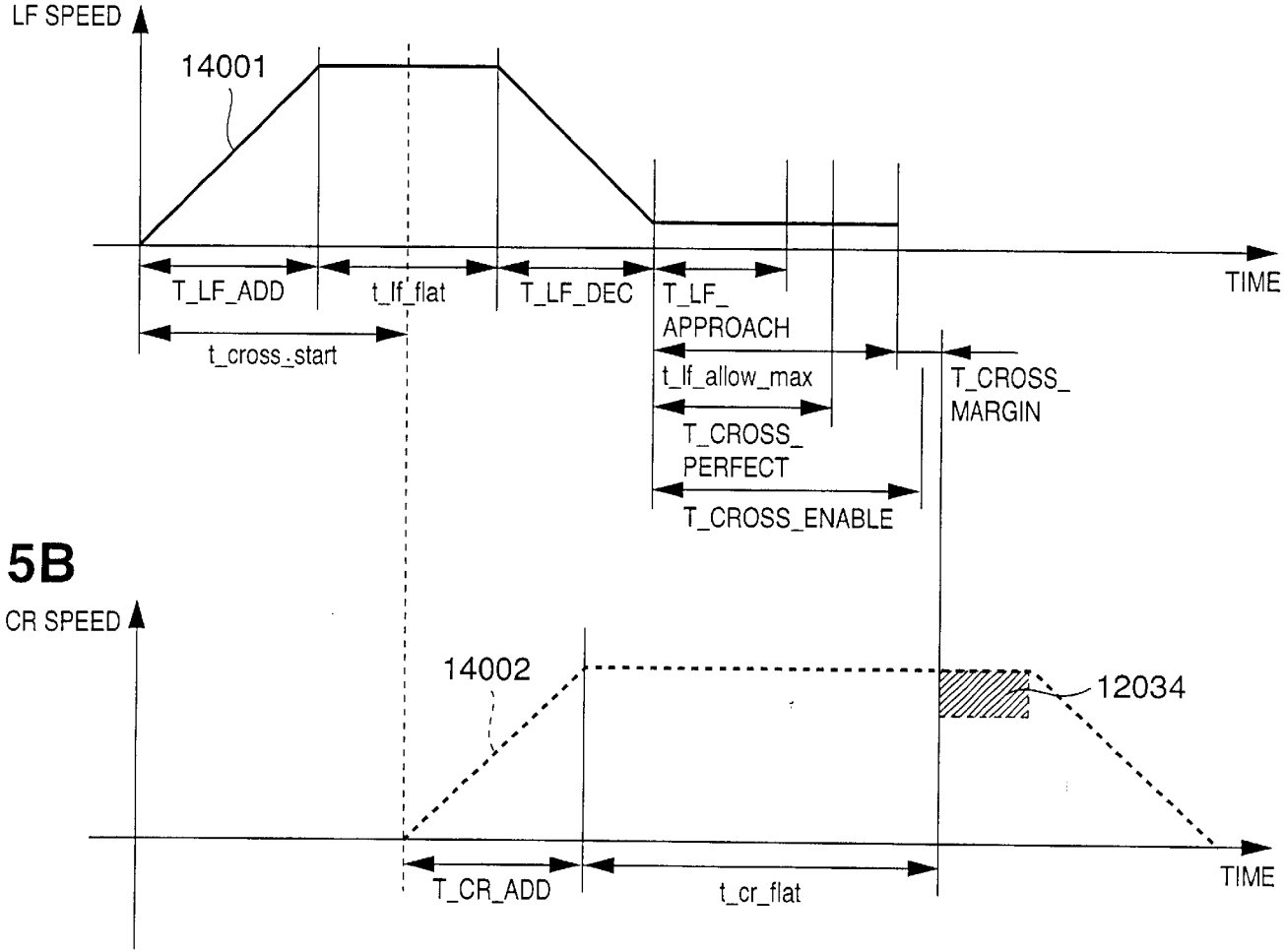
FIGS. 15A and 15B are timing charts for explaining processing according to the first embodiment of the present invention in detail.
Figure 16A:
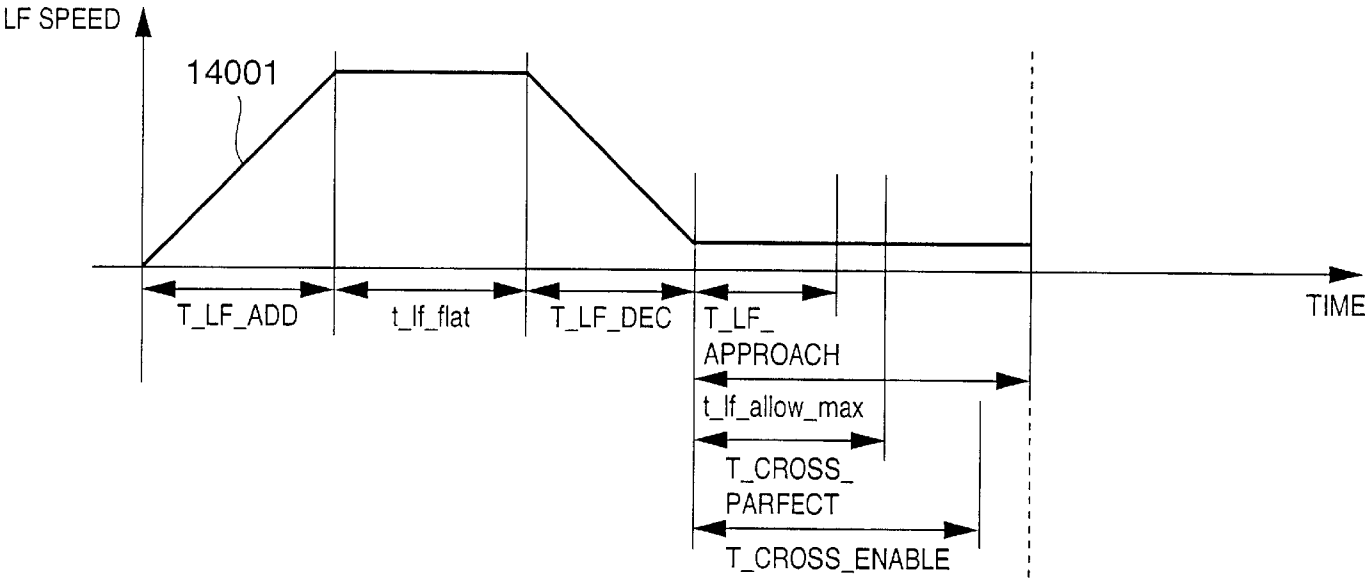
FIGS. 16A and 16B are timing charts related to processing according to the first embodiment of the present invention in detail.
Figure 16B:
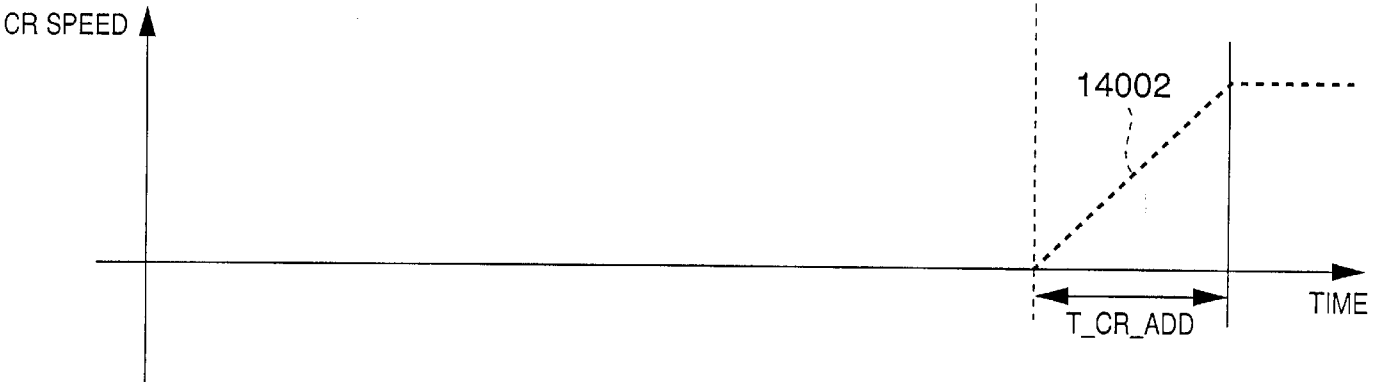

Referring to FIGS. 14A, 14B, 15A, 15B, 16A, and 16B, the abscissa represents the time, and the ordinates represent the speeds of the motors. FIGS. 14A, 15A, and 16A show the processing related to sub-scanning. FIGS. 14B, 15B, and 16B show the processing related to the main scanning direction.

A time t_lf_flat is a paper feeding time that changes depending on the print data. The time t_lf_flat has a variable value. Note that the time t_lf_flat has a variable value that changes only depending on the logical request (since the feed amount changes to any value depending on the print data) of printing processing independently of disturbance, unlike the time t_lf_allow described above, which has a variable value that changes due to disturbance.

A time T_CR_ADD is a time required for acceleration in the main scanning direction. In this embodiment, a description will be made assuming a case wherein the acceleration performance in the main scanning direction is stable, and the value T_CR_ADD can be handled as a constant.

A time t_cr_flat is a time from the end of acceleration in the main scanning direction to the activation of ink discharge processing. The time t_cr_flat is determined on the basis of the left and right ends of print data, the printing direction, and the current position of the carriage. The time t_cr_flat freely changes depending on the combination of the values. A calculation method therefor is known, and a description thereof will be omitted.

A time T_LF_APPROACH is a time from the end of deceleration to the stop, which is supposed in the ideal state.

T_CROSS_MARGIN is a margin value used in each calculation to be described below. As a characteristic feature of the present invention, a settling time that would emerge for control in the future is estimated using the history of settling times recorded for control in the past. However, DC motor control is dynamic. The settling times recorded for control in the past do not promise all situations that would take place in the future. To more safely estimate control of the dynamically changing object to be controlled, the history in the past must be summarized, and a margin must be taken into consideration in advance as the maximum change amount expected in the system to be controlled. T_CROSS_MARGIN means that margin.

FIGS. 14A and 14B show a case wherein T_CROSS_PERFECT is dominant as a direct value that determines the depth of cross. T_CROSS_PERFECT is a constant for determining the time that determines the deepest cross value. The sum of T_CROSS_PERFECT and T_CROSS_MARGIN corresponds to the deepest degree of cross that is allowable in the system to be controlled. That is, even in the deepest cross, activation of ink discharge processing is not permitted after the end of the ideal deceleration control region before (T_CROSS_PERFECT+T_CROSS_MARGIN) has elapsed. T_CROSS_PERFECT is a value that guarantees the timing management.

In a completely ideal system, T_CROSS_MARGIN can be 0, and T_CROSS_PERFECT can equal T_LF_APPROACH.

This takes thought for a risk that if sub-scanning driving stops in a time shorter than T_LF_APPROACH, and the next cross control is executed on the basis of that short time, skew printing may occur. This is because so long as control is executed by setting T_LF_APPROACH as the ideal time from the end of deceleration to the stop, even if sub-scanning driving stops in a time shorter than T_LF_APPROACH, it is risky to execute the next driving cycle on the basis of the short time. The first object of the present invention is to completely avoid the risk of skew printing. The second object of the present invention is to make cross control as deep as possible while avoiding any skew printing. Setting T_CROSS_PERFECT guarantees achieving the first object.

FIGS. 16A and 16B show a case wherein T_CROSS_ENABLE is dominant as a direct value that determines the depth of cross.

T_CROSS_ENABLE is a constant time value which is set in consideration of the longest sub-scanning settling time supposed in the normal system state. When driving that will not stop even after the end of the ideal deceleration control region and the elapse of T_CROSS_ENABLE is detected, it is determined that the sub-scanning driving is abnormal. Processing is executed while supposing that operation that the estimate processing of the present invention cannot cope with is being performed. That is, the history in the past cannot serve as the base of driving in the future. In such a situation, even shallow cross control may cause skew printing. Hence, cross control is inhibited.

FIGS. 15A and 15B show a case wherein t_lf_allow_max is dominant as a direct value that determines the depth of cross.

The value t_lf_allow_max represents the longest required time from the end of the ideal deceleration control region to the stop, which is derived from the history in the past. If the history in the past completely guarantees driving in the future, the depth of cross can be determined by this value. However, in consideration of the dynamic DC motor control, the depth of cross control to be executed next is determined by a numerical value obtained by adding T_CROSS_MARGIN to the value.

Detailed processing for realizing the above operations will be described with reference to FIGS. 13A and 13B.

When the apparatus is powered on in step S13001, the region is initialized in step S13002.

In this case, mem_t_lf_allow [N] indicates a storage region that stores t_lf_allow recorded in N driving cycles in the past. In step S13002, initial values T_LF_ALLOW_INIT0 to T_LF_ALLOW_INITN are stored in this storage region.

It is checked in step S13003 whether a print (driving both LF and CR) instruction is received. If YES in step S13003, the flow advances to step S13005. Printing processing using cross control and recording of t_lf_allow detected at the time of sub-scanning driving are executed.

If NO in step S13003, the flow advances to step S13004 to check whether a paper feed (only LF) instruction is received. If YES in step S13004, the flow advances to step S13011 to inhibit unnecessary cross control, execute sub-scanning driving, and record t_lf_allow detected in sub-scanning driving.

Details of processing from step S13005 will be described next.

In step S13005, t_cr_flat is calculated on the basis of the left and right ends of print data, the printing direction, and the current carriage position. The flow advances to step S13006 to extract the maximum value in the region mem_t_lf_allow [N] and substitute it into t_lf_allow_max.

In step S13007, t_lf_allow_max and T_CROSS_ENABLE are compared. If the former is larger, the flow advances to step S13011 to set cross_sw=DISABLE to inhibit cross control. Otherwise, the flow advances to step S13008 to set cross_sw=ENABLE to enable cross control. Then, the flow advances to step S13009.

In step S13009, t_lf_allow_max and T_CROSS_PERFECT are compared. If the former is larger, the flow advances to step S13012 to execute calculation for determining t_cross_start on the basis of t_lf_allow_max. Then, the flow advances to step S11012. Otherwise, the flow advances to step S13010 to execute calculation for determining t_cross_start on the basis of T_CROSS_PERFECT. Then, the flow advances to step S11012.

In work region setting processing in step S13013, various setting operations such as feedback control gain setting necessary for sub-scanning driving are performed. The timer is activated in step S13014. Steps S13013 and S13014 correspond to the signal 11012 (FIG. 12) described above.

Step S13015 indicates processing executed by the signal 11013 in FIG. 12. Only when cross_sw=ENABLE, a driving start command event is issued to the CR motor control task at the moment when t_cross_start has elapsed after activation of the timer.

Steps S13017 to S13019 indicate processing corresponding to the drive control end 11015 in FIG. 12.

In step S13017, the driving start command event is issued to the CR motor control task. Only when no driving start command event is issued because cross_sw =DISABLE in step S13015, the main scanning motor starts driving in step S13017.

In steps S13018 and S13019, information in the region mem_t_lf_allow [N] is shifted by one. The oldest information is discarded, and instead, the latest value is stored.

With the above-described processing, the operations shown in FIGS. 14A, 14B, 15A, 15B, 16A, and 16B are realized.

A supplementary explanation will be made about the meaning of setting of the initial values T_LF_ALLOW_INIT0 to T_LF_ALLOW_INITN in the above-described processing.

When these settings have appropriate values, the value of cross after power-on can be flexibly set. For example, for mass-produced products with a large variation, the initial values are set in advance to be relatively large, thereby reliably avoiding any risk of skew printing immediately after power-on. Then, t_lf_allow for each system is stored in the region mem_t_lf_allow [N]. With this processing, the potential of each system can be brought out at maximum while avoiding any skew printing.

Alternatively, when only the first numerical value of the initial values T_LF_ALLOW_INIT0 to T_LF_ALLOW_INITN is set to be relatively large, only the margin for avoiding the risk of skew printing for scanning immediately after power-on is increased. After that, the actual value t_lf_allow suitable of each system is made dominant. With this processing, tuning can be executed such that the potential of each system can be brought out as quickly as possible.

<Second Embodiment>

The arrangement of this embodiment is the same as that of the apparatus of the first embodiment except the processing in FIGS. 13A and 13B in the apparatus described in the first embodiment, and a description thereof will be omitted.

The purpose of this embodiment is to identify operation that should not be subjected to cross control on the basis of the difference in servo processing and to inhibit cross control for such operation.

As already described with reference to FIG. 7, in general sub-scanning driving, position servo shown in FIG. 5 is employed for an acceleration control region 2011, constant speed control region 2012, and deceleration control region 2013, and speed servo shown in FIG. 6 is employed for a positioning control region 2014.

However, in sub-scanning driving with a smaller feed amount, it is difficult to ensure the regions 2011, 2012, and 2013 in the small feed amount. In this case, the whole region from the start to the end of driving is controlled by speed servo shown in FIG. 6. In speed servo, feedback control is executed to attain an ideal speed at given time. For this reason, the degree of delay of the position at each time is accumulated without being fed back. Hence, the time of arrival at a given position cannot be guaranteed. That is, the settling time is expected to largely vary.

In this embodiment, in consideration of this problem, a means for inhibiting cross control in sub-scanning driving using only speed servo is provided.

Figure 17A:
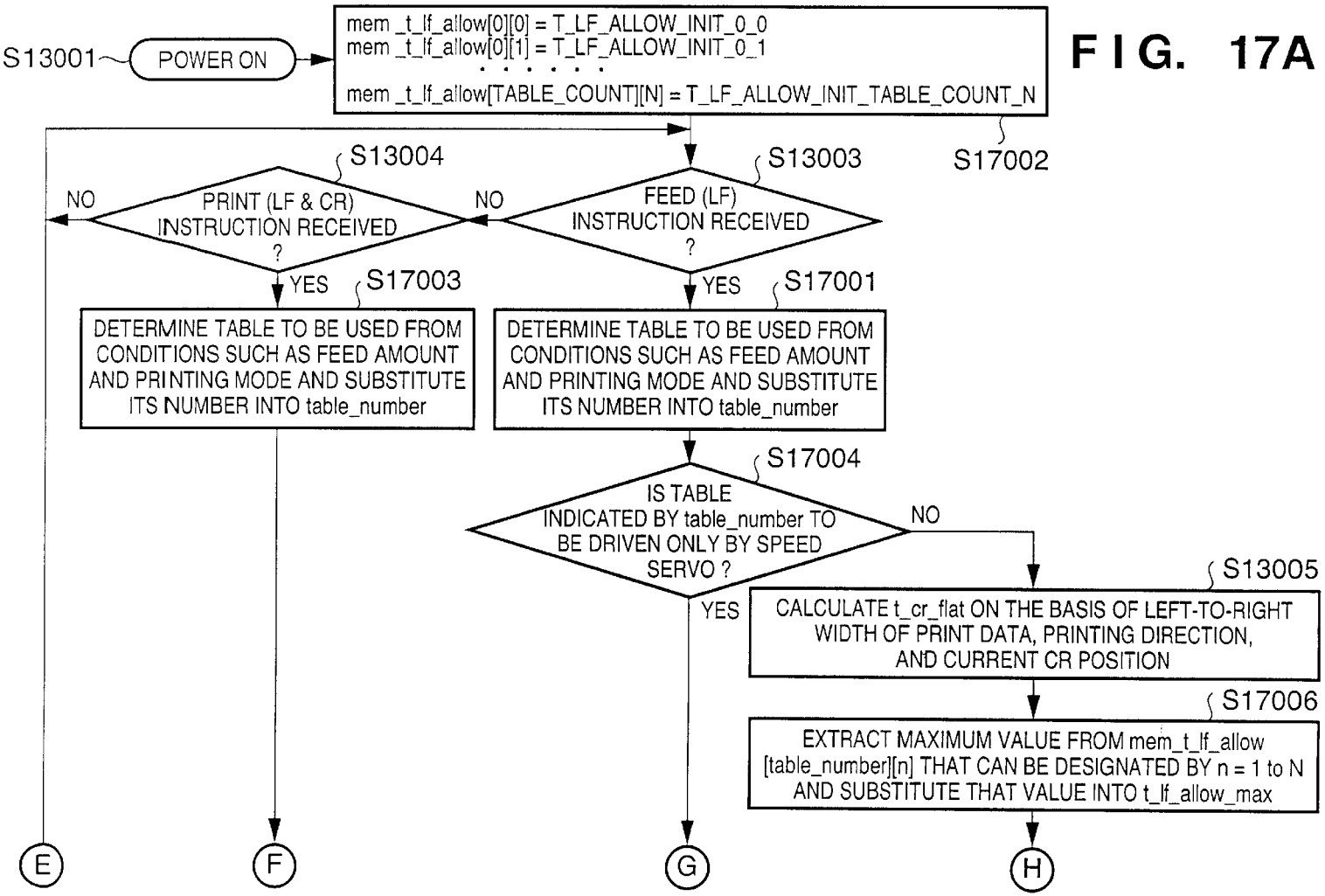
FIGS. 17A and 17B are flow charts for explaining processing according to another embodiment of the present invention in detail.
Figure 17B:
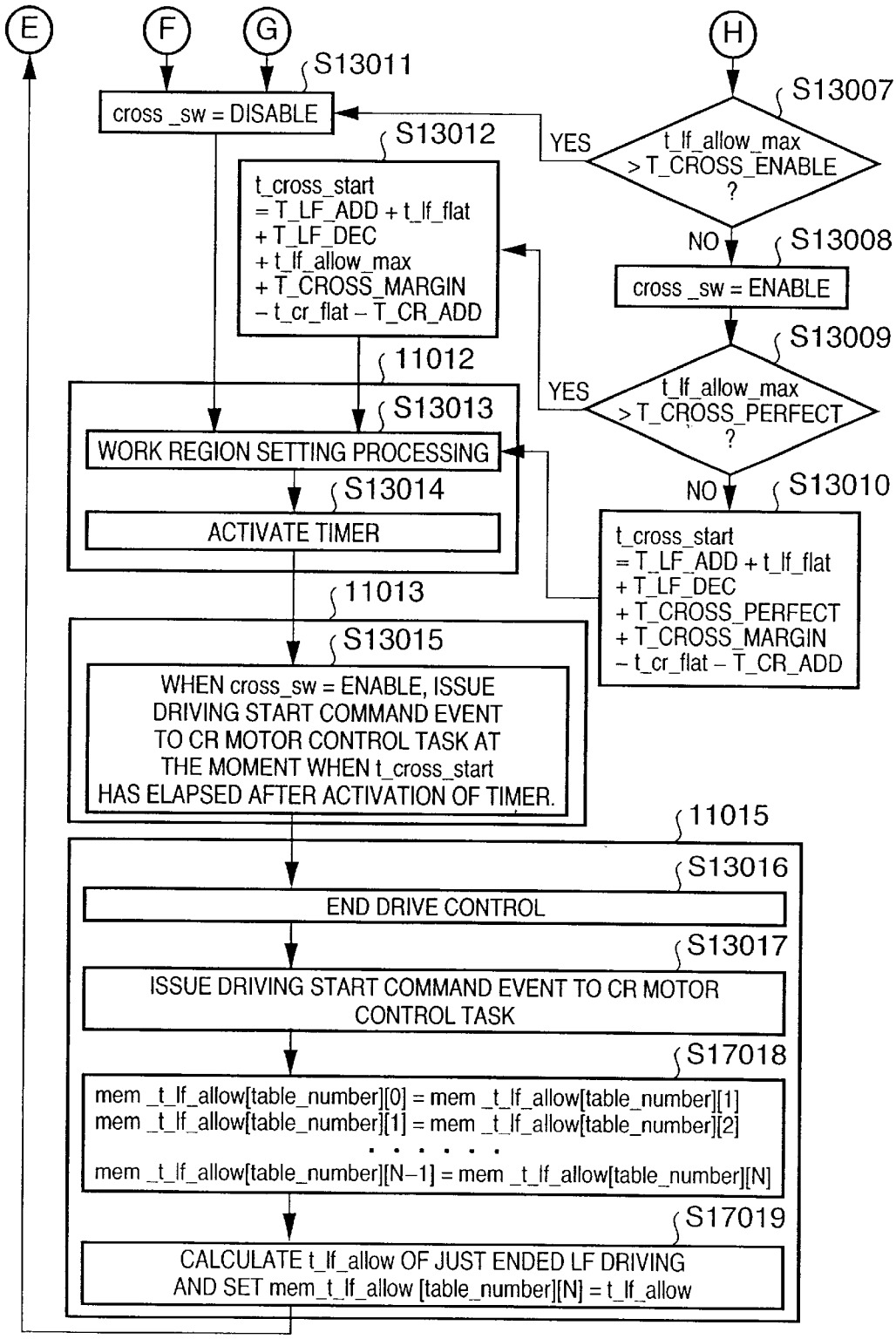

FIGS. 17A and 17B are flow charts showing processing as the gist of this embodiment in detail. Processing operations having the same contents as those described with reference to FIGS. 13A and 13B are indicated by the same step numbers as in FIGS. 13A and 13B.

When the apparatus is powered on in step S13001, the region is initialized in step S17002.

TABLE_COUNT indicates the total number of sub-scanning (LF) tables held by the apparatus to be controlled. Here, mem_t_lf_allow [TABLE_COUNT] [N] indicates a storage region that stores t_lf_allow recorded in N driving cycles in the past for each table.

In step S17002, initial values T_LF_ALLOW_INIT0_0 to T_LF_ALLOW_INIT_TABLE_COUNT_N are stored in this storage region.

It is checked in step S13003 whether a print (driving both LF and CR) instruction is received. If YES in step S13003, the flow advances to step S17001 to determine a table to be used, on the basis of conditions such as the feed amount and printing mode, and store the number of table in a variable table_number.

It is determined in step S17004 whether the table indicated by table_number is driven only by speed servo. If YES in step S17004, the flow advances to step S13011 to inhibit unnecessary cross control. Then, sub-scanning driving is executed using the driving table corresponding to table_number, and t_lf_allow detected in sub-scanning driving is recorded. Otherwise, the flow advances to step S13005.

From step S13005, printing processing using cross control and recording of t_lf_allow detected at the time of sub-scanning driving are executed.

If NO in step S13003, the flow advances to step S13004 to check whether a paper feed (only LF) instruction is received. If YES in step S13004, the flow advances to step S17003 to determine a table to be used, on the basis of conditions such as the feed amount and printing mode, and store the number of table in the variable table_number.

The flow advances to step S13011 to inhibit unnecessary cross control. Then, sub-scanning driving is executed using the driving table corresponding to table_number, and t_lf_allow detected in sub-scanning driving is recorded.

Details of processing from step S13005 will be described next.

In step S13005, t_cr_flat is calculated on the basis of the left and right ends of print data, the printing direction, and the current carriage position.

The flow advances to step S17006 to extract the maximum value in the region mem_t_lf_allow [table_number] [N] and substitute it into t_lf_allow_max.

In step S13007, t_lf_allow_max and T_CROSS_ENABLE are compared. If the former is larger, the flow advances to step S13011 to set cross_sw=DISABLE to inhibit cross control. Otherwise, the flow advances to step S13008 to set cross_sw=ENABLE to enable cross control. Then, the flow advances to step S13009.

In step S13009, t_lf_allow_max and T_CROSS_PERFECT are compared. If the former is larger, the flow advances to step S13012 to execute calculation for determining t_cross_start on the basis of t_lf_allow_max. Then, the flow advances to step S11012. Otherwise, the flow advances to step S13010 to execute calculation for determining t_cross_start on the basis of T_CROSS_PERFECT. Then, the flow advances to step S11012.

In work region setting processing in step S13013, various setting operations such as feedback control gain setting necessary for sub-scanning driving are performed. The timer is activated in step S13014. Steps S13013 and S13014 correspond to the signal 11012 described above.

Step S13015 indicates processing executed by the signal 11013 in FIG. 12. Only when cross_sw=ENABLE, a driving start command event is issued to the CR motor control task at the moment when t_cross_start has elapsed after activation of the timer.

Steps S13017 to S13019 indicate processing corresponding to the drive control end 11015 in FIG. 12.

In step S13017, the driving start command event is issued to the CR motor control task. Only when no driving start command event is issued because cross_sw=DISABLE in step S13015, the main scanning motor starts driving in step S13017.

In steps S13018 and S13019, information in the region mem_t_lf_allow [table_number] [N] is shifted by one. The oldest information is discarded, and instead, the latest value is stored.

With the above-described processing, cross control can be inhibited in speed servo with an unstable settling time, so the risk of skew printing can be avoided.

<Third Embodiment>

The arrangement of this embodiment is the same as that of the apparatus of the first embodiment except the processing in FIGS. 13A and 13B in the apparatus described in the first embodiment, and a description thereof will be omitted.

The purpose of this embodiment is to calculate t_cross_start in consideration of even a variation in acceleration time T_CR_ADD in main scanning, which is neglected in the first embodiment.

Figure 18A:
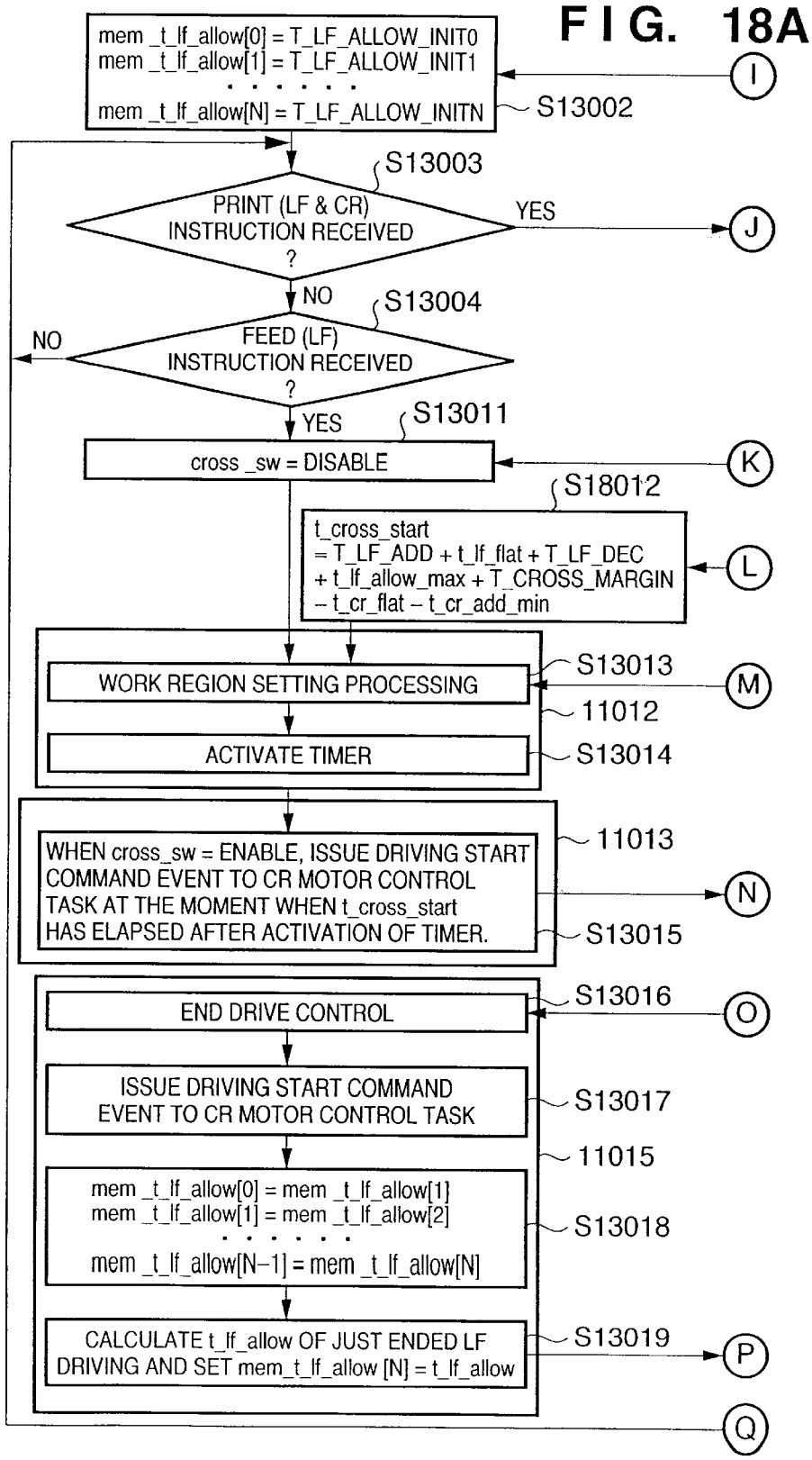
FIGS. 18A and 18B are flow charts related to processing according to still another embodiment of the present invention in detail.
Figure 18B:
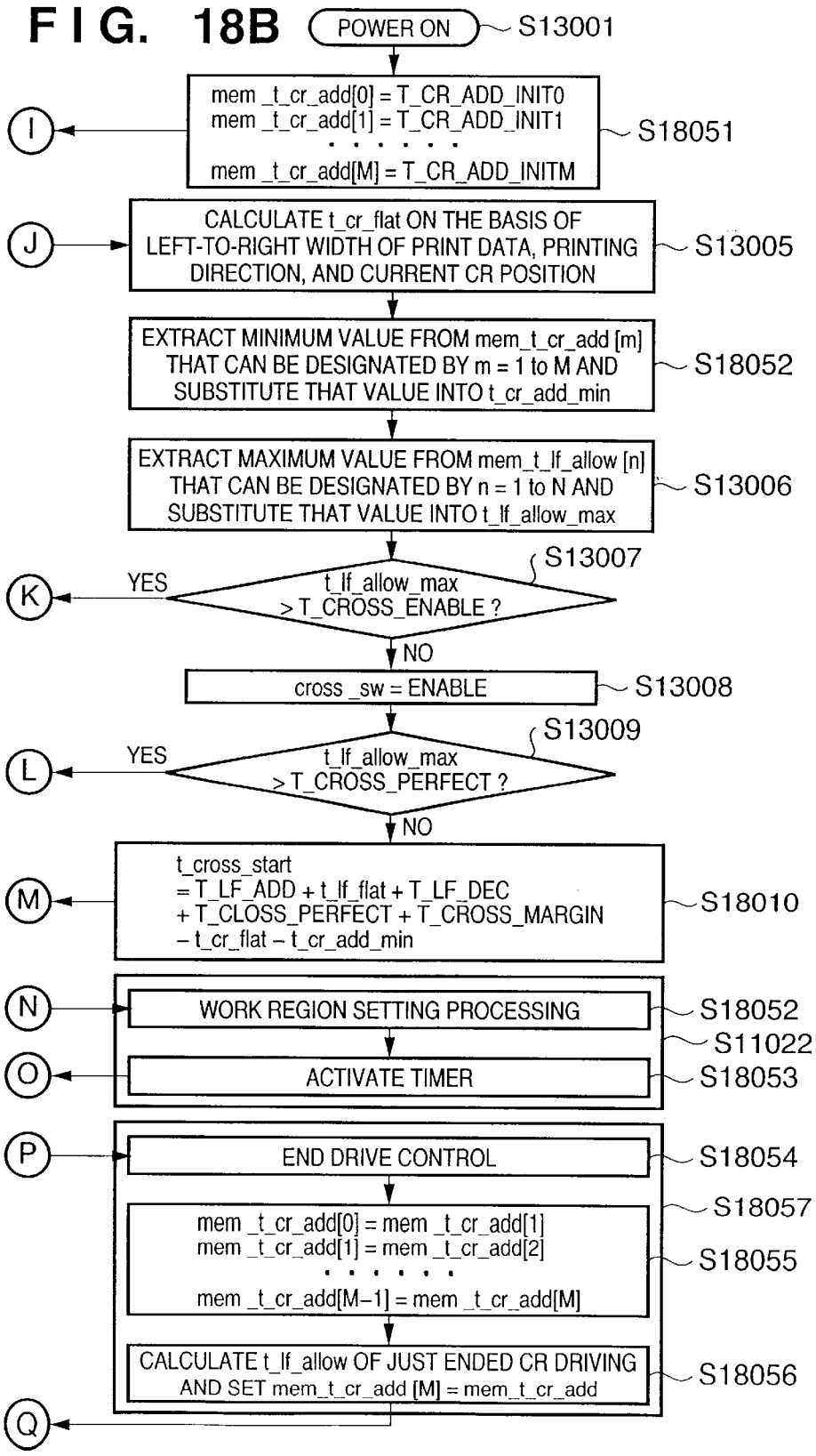

FIGS. 18A and 18B are flow charts showing processing as the gist of this embodiment in detail. Processing operations having the same contents as those described with reference to FIGS. 13A and 13B are indicated by the same step numbers as in FIGS. 13A and 13B.

Processing operations except steps S18051, S18052, S18012, S18010, S11022, and S18052 to S18057 are the same as those in FIGS. 13A and 13B, and a description thereof will be omitted.

Step S18051 indicates initialization processing after power-on, and men_t_cr_add [M] is a storage region which stores an actual acceleration time t_cr_add in main scanning, which is recorded in N driving cycles in the past.

In step S18051, initial values T_CR_ADD_INIT0 to T_CR_ADD_INITM are stored in this storage region.

Step S18052 indicates processing of extracting the minimum value from men_t_cr_add [m] which can be designated by m=1 to M and calculating t_cr_add_min. Using t_cr_add_min, t_cross_start is calculated in step S18012.

Steps S18053 and S18054 indicate actual processing in step S11022, though a description thereof has been omitted in the first embodiment. The processing in step S11022 is activated by an event issued in step S13015. After that, actual driving processing in the main scanning direction is executed in step S11023, though it is not illustrated in the flow chart. When the processing stops, the flow advances to step S18057. In step S18057, in main scanning, the end of main scanning drive control is controlled, like step S11015 in which the end of sub-scanning drive control is controlled. The processing in step S18054 corresponds to the processing in sub-scanning in step S13016.

In steps S18055 and S18056, information in the region mem_t_cr_add [M] is shifted by one. The oldest information is discarded, and instead, the latest value is stored.

With the above-described processing, cross control can be realized in consideration of a variation in actual acceleration time in main scanning.

<Fourth Embodiment>

Figure 19:
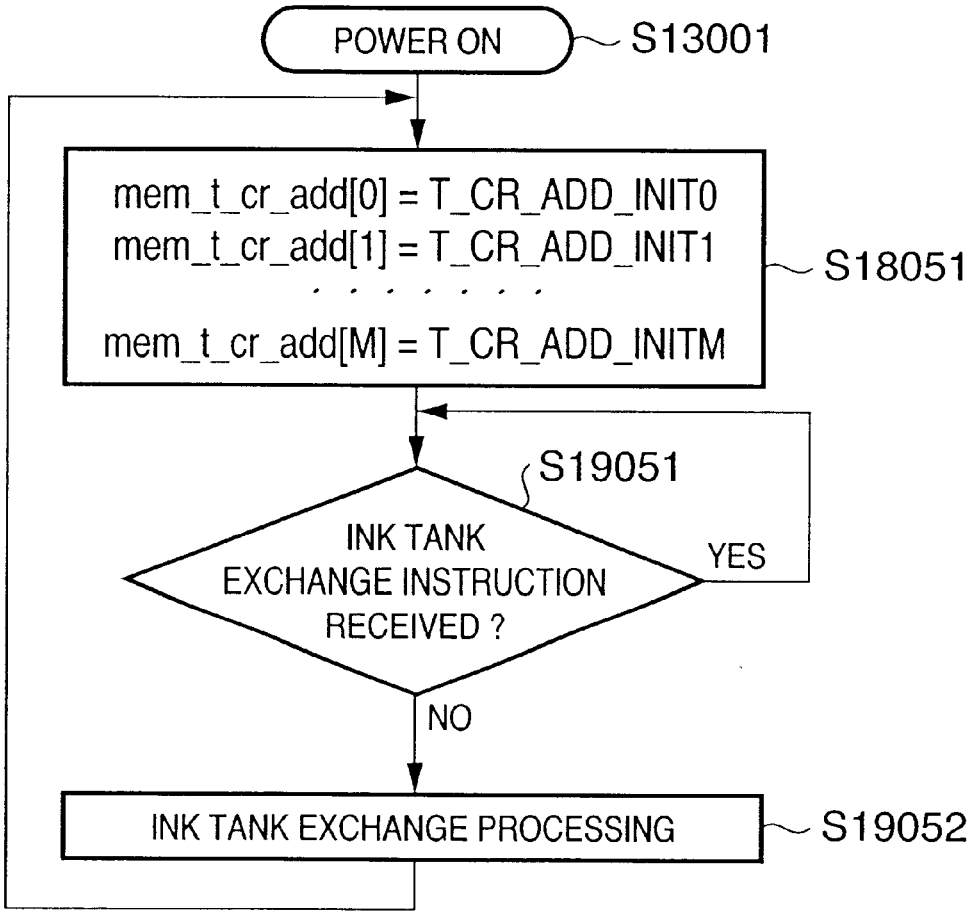
FIG. 19 is a flow chart for explaining processing according to still another embodiment of the present invention in detail.

In this embodiment, control shown in FIG. 19 is added to the processing described in the third embodiment. The arrangement of other parts is the same as in the third embodiment, and a description thereof will be omitted.

Referring to FIG. 19, when the apparatus is powered on in step S13001, initial values are set in men_t_cr_add [M] in step 18051.

Step S19051 indicates processing of detecting whether an ink tank exchange instruction is received. If YES in step S19051, ink tank exchange processing is executed in step S19052, and the flow returns to step S18051.

If the load on the carriage is expected to largely vary due to a change in ink tank weight, the region men_t_cr_add [M] can be initialized. Hence, even when the load on the carriage largely varies, any inappropriate control with reference to the history in the past can be prevented.

In addition, when a printing medium is conveyed in a line feed direction by a printing medium convey mechanism, the presence/absence of an object to be conveyed and a variation in load of the object to be conveyed may be measured. On the basis of the results, the history information of the sub-scanning settling time may be initialized.

With this processing, when a large load variation occurs on the object to be conveyed, any inappropriate control with reference to the history in the past can be prevented.

<Fifth Embodiment>

As the characteristic feature of an apparatus of this embodiment, the same arrangement as that of the apparatus described in the first embodiment is employed, and a means for, at the time of power-off, storing values in a region mem_t_lf_allow [N] in a nonvolatile RAM such as an EEP-ROM and, at the time of power-on, setting the initial values in the region mem_t_lf_allow [N] by rewriting the information in the nonvolatile RAM instead of step S13002 is prepared.

In the apparatus described in the first embodiment, the default initial values T_LF_ALLOW_INIT0 to T_LF_ALLOW_INITN in the region mem_t_lf_allow [N] are re-set every time the apparatus is powered on. Unlike this, the region mem_t_lf_allow [N] can be continuously reflected without any influence of power-on/off. Hence, optimum cross control can be executed immediately after power-on.

As has been described above, according to the present invention, in sub-scanning and main scanning cross control which is indispensable for a printing apparatus, i.e., a serial printer with a higher speed, the cross between sub-scanning and main scanning can be made as deep as possible while avoiding the risk of skew printing. Hence, the processing speed can be increased.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus comprising:

first storage means for recording a history of a sub-scanning settling time;

second storage means for recording a history of a main scanning acceleration required time;

supposed settling time determination means for obtaining a supposed settling time in a next sub-scanning driving cycle on the basis of the history information of the sub-scanning settling time stored in said first storage means;

supposed idle time determination means for obtaining a supposed idle time from a next start of main scanning driving to a start of printing on the basis of the history information of the main scanning acceleration required time stored in said second storage means;

determination means for determining using the supposed settling time and the supposed idle time whether cross control in which main scanning driving starts before an end of sub-scanning driving can be executed in next print scanning processing; and time difference determination means for determining a time difference from a start of sub-scanning driving to the start of main scanning driving using the supposed settling time and the supposed idle time on the basis of determination by said determination means in order to execute cross control in a next print scanning cycle.

2. The apparatus according to claim 1, wherein said first storage means stores the sub-scanning settling times in N sub-scanning driving cycles in the past as the history information, and said supposed settling time determination means employs a maximum value stored in said first storage means as the supposed settling time in the next sub-scanning driving cycle.

3. The apparatus according to claim 1, wherein said second storage means stores the main scanning acceleration required times in M main scanning driving cycles in the past as the history information, and said supposed idle time determination means employs a minimum value stored in said second storage means as the supposed idle time in the next main scanning driving cycle.

4. The apparatus according to claim 1, wherein said time difference determination means employs, as the time difference, a time value obtained by adding a predetermined margin time to a time value obtained by subtracting the supposed idle time from the supposed settling time.

5. The apparatus according to claim 1, wherein only when the supposed settling time is shorter than a preset allowable maximum settling time, said determination means determines that cross control can be executed.

6. The apparatus according to claim 1, wherein when the supposed settling time exceeds a preset allowable maximum settling time, said determination means inhibits cross control.

7. The apparatus according to claim 1, wherein when the supposed settling time exceeds a preset allowable maximum settling time, said determination means switches to control for starting a main scanning operation after an end of a sub-scanning operation.

8. The apparatus according to claim 1, wherein upon powering on, said supposed settling time determination means employs, as an initial condition, a maximum sub-scanning settling time in the history information of the sub-scanning settling times of N cycles in the past from said first storage means.

9. The apparatus according to claim 1, wherein upon powering on, said supposed idle time determination means employs, as an initial condition, a minimum main scanning acceleration time in the history information of the main scanning acceleration times of M cycles in the past from said second storage means.

10. The apparatus according to claim 1, wherein said first storage means stores the history information of the sub-scanning settling times of N cycles in the past in correspondence with each printing condition, and said supposed settling time determination means employs a sub-scanning settling time of a corresponding printing condition as an initial condition in accordance with a print instruction.

11. The apparatus according to claim 10, wherein the printing condition includes a feed amount of a printing medium or a printing mode.

12. The apparatus according to claim 1, wherein a DC motor is employed as a main scanning driving source.

13. The apparatus according to claim 1, wherein a DC motor is employed as a sub-scanning driving source.

14. The apparatus according to claim 1, wherein the apparatus further comprises measurement means for measuring a variation in load on a carriage, and the history information of the main scanning acceleration required time stored in said second storage means is initialized on the basis of a measurement result from said first measurement means.

15. The apparatus according to claim 1, wherein the apparatus further comprises load measurement means for measuring a load variation of a printing medium on a convey mechanism, and the history information of the sub-scanning settling time stored in said first storage means is initialized on the basis of a measurement result from said load measurement means.

16. The apparatus according to claim 1, wherein the history of the sub-scanning settling time and the history of the main scanning acceleration required time are stored in a nonvolatile memory, and the information can remain stored even after power-off.

17. The apparatus according to claim 1, wherein when control is executed by feedback using only speed information without using any position information, said determination means inhibits cross control.

18. A printing control method of controlling a printing apparatus, comprising:

a first storage step of recording a history of a sub-scanning settling time of the printing apparatus in a memory;

a second storage step of recording a history of a main scanning acceleration required time of the printing apparatus in a memory;

a supposed settling time determination step of obtaining a supposed settling time in a next sub-scanning driving cycle on the basis of the history information of the sub-scanning settling time stored in the first storage step;

a supposed idle time determination step of obtaining a supposed idle time from a next start of main scanning driving to a start of printing on the basis of the history information of the main scanning acceleration required time stored in the second storage step;

a determination step of determining using the supposed settling time and the supposed idle time whether cross control in which main scanning driving starts before an end of sub-scanning driving can be executed in next print scanning processing; and a time difference determination step of determining a time difference from a start of sub-scanning driving to the start of main scanning driving using the supposed settling time and the supposed idle time on the basis of determination in the determination step in order to execute cross control in a next print scanning cycle.

19. The method according to claim 18, wherein in the first storage step, the sub-scanning settling times in N sub-scanning driving cycles in the past are stored as the history information, and in the supposed settling time determination step, a maximum value stored in the first storage step is employed as the supposed settling time in the next sub-scanning driving cycle.

20. The method according to claim 18, wherein in the second storage step, the main scanning acceleration required times in M main scanning driving cycles in the past are stored as the history information, and in the supposed idle time determination step, a minimum value stored in the second storage step is employed as the supposed idle time in the next main scanning driving cycle.

21. The method according to claim 18, wherein in the time difference determination step, a time value obtained by adding a predetermined margin time to a time value obtained by subtracting the supposed idle time from the supposed settling time is employed as the time difference.

22. The method according to claim 18, wherein only when the supposed settling time is shorter than a preset allowable maximum settling time, it is determined in the determination step that cross control can be executed.

23. The method according to claim 18, wherein when the supposed settling time exceeds a preset allowable maximum settling time, cross control is inhibited in the determination step.

24. The method according to claim 18, wherein when the supposed settling time exceeds a preset allowable maximum settling time, in the determination step, control is switched to control for starting a main scanning operation after an end of a sub-scanning operation.

25. The method according to claim 18, wherein in the supposed settling time determination step, upon powering on, a maximum sub-scanning settling time in the history information of the sub-scanning settling times of N cycles in the past, which are stored in the first storage step, is employed as an initial condition.

26. The method according to claim 18, wherein in the supposed idle time determination step, upon powering on, a minimum main scanning acceleration time in the history information of the main scanning acceleration times of M cycles in the past, which are stored in the second storage step, is employed as an initial condition.

27. The method according to claim 18, wherein in the first storage step, the history information of the sub-scanning settling times of N cycles in the past is stored in the memory in correspondence with each printing condition, and in the supposed settling time determination step, a sub-scanning settling time of a corresponding printing condition is employed as an initial condition in accordance with a print instruction.

28. The method according to claim 27, wherein the printing condition includes a feed amount of a printing medium or a printing mode.

29. The method according to claim 18, wherein the method further comprises a measurement step of measuring a variation in load on a carriage, and in the second storage step, the history information of the main scanning acceleration required time stored in the memory is initialized on the basis of a measurement result in the measurement step.

30. The method according to claim 18, wherein the method further comprises a load measurement step of measuring a load variation of a printing medium on a convey mechanism, and in the first storage step, the history information of the sub-scanning settling time stored in the memory is initialized on the basis of a measurement result in the load measurement step.

31. The method according to claim 18, wherein when control is executed by feedback using only speed information without using any position information, cross control is inhibited in the determination step.

32. A computer-readable storage medium which stores a program code that realizes the printing control method of claim 18.

33. A printing control program which causes a computer to function to control a printing apparatus, the program comprising:

first storage means for recording a history of a sub-scanning settling time;

second storage means for recording a history of a main scanning acceleration required time;

supposed settling time determination means for obtaining a supposed settling time in a next sub-scanning driving cycle on the basis of the history information of the sub-scanning settling time stored in said first storage means;

supposed idle time determination means for obtaining a supposed idle time from a next start of main scanning driving to a start of printing on the basis of the history information of the main scanning acceleration required time stored in said second storage means;

determination means for determining using the supposed settling time and the supposed idle time whether cross control in which main scanning driving starts before an end of sub-scanning driving can be executed in next print scanning processing; and time difference determination means for determining a time difference from a start of sub-scanning driving to the start of main scanning driving using the supposed settling time and the supposed idle time on the basis of determination by said determination means in order to execute cross control in a next print scanning cycle.

34. A printing apparatus comprising:

storage means for recording a history of a sub-scanning settling time;

supposed settling time determination means for obtaining a supposed settling time in a next sub-scanning driving cycle on the basis of the history information of the sub-scanning settling time stored in said storage means;

supposed idle time determination means for obtaining a supposed idle time from a start of main scanning driving to a start of printing on the basis of print data;

determination means for determining using the supposed settling time and the supposed idle time whether cross control in which main scanning driving starts before an end of sub-scanning driving can be executed in next print scanning processing; and time difference determination means for determining a time difference from a start of sub-scanning driving to the start of main scanning driving using the supposed settling time and the supposed idle time on the basis of determination by said determination means in order to execute cross control in a next print scanning cycle.

35. A printing control means of controlling a printing apparatus comprising the steps of:

recording a history of a sub-scanning settling time;

obtaining a supposed settling time in a next sub-scanning driving cycle on the basis of the history information of the sub-scanning settling time stored in said recording step;

obtaining a supposed idle time from a start of main scanning driving to a start of printing on the basis of a print data;

determining using the supposed settling time and the supposed idle time whether cross control in which main scanning driving starts before an end of sub-scanning driving can be executed in next print scanning processing; and determining a time difference from a start of sub-scanning driving to the start of main scanning driving using the supposed settling time and the supposed idle time on the basis of determination by said determining step using the supposed settling time and the supposed idle time in order to execute cross control in a next print scanning cycle.

36. A printing apparatus comprising:

main scanning drive means for driving a carriage mounting a recording head in a main scanning direction;

sub-scanning drive means for feeding a recording medium in a sub-scanning direction;

first storage means for storing time information related to time required from termination of a predetermined deceleration control region of said sub-scanning drive means to stoppage of said sub-scanning drive means;

second storage means for storing time information related to time required for acceleration of said main scanning drive means;

first time acquisition means for acquiring a time from termination of the predetermined deceleration control region to stoppage in a next feeding operation based on time information stored in said first storage means;

second time acquisition means for acquiring a time from start of a next carriage drive operation to start of recording by the recording head, based on time information stored in said second storage means;

determining means for determining whether or not a main scanning drive of the carriage can be started before a completion of a sub-scanning drive of the recording medium in a next recording scanning, using the time from termination of the predetermined deceleration control region to stoppage and predetermined time information; and calculating means for calculating the carriage drive start timing after the start of the sub-scanning drive using the information related to the time required from the termination of the predetermined deceleration control region to stoppage and time from the start of carriage drive to the start of recording head recording, in a case that said determining means determines that the main scanning drive of the carriage can be started before the completion of the sub-scanning drive of the recording medium in the next recording scanning.

37. A printing method comprising:

a main scanning drive step of driving a carriage mounting a recording head in a main scanning direction;

a sub-scanning drive step of feeding a recording medium in a sub-scanning direction;

a first storage step of storing, in a first storage means, time information related to time required from termination of a predetermined deceleration control region of a sub-scanning drive means to stoppage of the sub-scanning drive means;

a second storage step of storing, in a second storage means, time information related to time required for acceleration of a main scanning drive means;

a first time acquisition step of acquiring a time from termination of the predetermined deceleration control region to stoppage in a next feeding operation based on time information stored in the first storage means;

a second time acquisition step of acquiring a time from start of a next carriage drive operation to start of recording by the recording head, based on time information stored in the second storage means;

a determining step of determining whether or not a main scanning drive of the carriage can be started before a completion of a sub-scanning drive of the recording medium in a next recording scanning, using the time from termination of the predetermined deceleration control region to stoppage and predetermined time information; and a calculating step of calculating the carriage drive start timing after the start of sub-scanning drive using the information related to the time required from the termination of the predetermined deceleration control region to stoppage and time from the start of carriage drive to the start of recording head recording, in a case that said determining step determines that the main scanning drive of the carriage can be started before the completion of the sub-scanning drive of the recording medium in the next recording scanning.

38. A printing apparatus comprising:

main scanning drive means for driving a carriage mounting a recording head in a main scanning direction;

sub-scanning drive means for feeding a recording medium in a sub-scanning direction;

storage means for storing time information related to time required from termination of a predetermined deceleration control region of said sub-scanning drive means to stoppage of said sub-scanning drive means;

time acquisition means for acquiring a time from the termination of the predetermined deceleration control region to stoppage in a next sub-scanning operation based on the time information stored in said storage means;

time calculating means for calculating a time from start of carriage drive to start of recording in a next recording scanning based on recording data;

determining means for determining whether or not a main scanning drive of the carriage can be started before completion of a sub-scanning drive of the recording medium in the next recording scanning, using the time required from the termination of the predetermined deceleration control region to stoppage and predetermined time information; and calculating means for calculating the carriage drive start timing after the start of sub-scanning drive of the recording medium using the information related to the time required from the termination of the predetermined deceleration control region to stoppage and time from the start of carriage drive to the start of recording by the recording head, in a case that said determining means determines that the main scanning drive of the carriage can be started before the completion of the sub-scanning drive of the recording medium in the next recording scanning.

39. The printing apparatus of claim 38, wherein the predetermined deceleration control region is a region within which a deceleration control is performed by a position servo controlling according to a predetermined position profile.

40. The printing apparatus of claim 39, wherein a control from acceleration to deceleration is performed by the position servo controlling based on the predetermined position profile.

41. The printing apparatus of claim 39, wherein a second deceleration control by a position servo controlling and position control by a speed servo controlling are performed after the termination of the predetermined deceleration control region until stoppage according to a second predetermined position profile.

42. The printing apparatus of claim 38, wherein said calculating means that calculates the carriage drive start timing after the start of sub-scanning drive comprises comparing means for comparing a value acquired by said time acquisition means to a predetermined value and, depending on the result of comparison, performs the calculation using different time information in place of the time required from the termination of the predetermined deceleration control region to stoppage.

43. The printing apparatus of claim 38, wherein said storage means stores the time information relating to the time required from the termination of the predetermined deceleration control region to stoppage for N past sub-scanning drives, where N is a number.

44. The printing apparatus of claim 38, wherein said main scanning drive means is driven by a DC motor.

45. The printing apparatus of claim 38, wherein said sub-scanning drive means is driven by a DC motor.

46. The apparatus according to claim 38, wherein when the time required from termination of the predetermined deceleration control region to stoppage exceeds the predetermined time information, said determining means inhibits start of the main scanning drive of the carriage before completion of the sub-scanning drive of the recording medium in the next recording scanning.

47. A printing method comprising:

a main scanning drive step of driving a carriage mounting a recording head in a main scanning direction;

a sub-scanning drive step of feeding a recording medium in a sub-scanning direction;

a storage step of storing, in storage means, time information related to time required from termination of a predetermined deceleration control region of a sub-scanning drive means to stoppage of the sub-scanning drive means;

a time acquisition step of acquiring a time from the termination of the predetermined deceleration control region to stoppage in a next sub-scanning operation based on the time information stored in the storage means;

a time calculating step of calculating a time from start of carriage drive to start of recording in a next recording scanning based on recording data;

a determining step of determining whether or not a main scanning drive of the carriage can be started before completion of a sub-scanning drive of the recording medium in the next recording scanning, using the time required from the termination of the predetermined deceleration control region to stoppage and predetermined time information; and a calculating step of calculating the carriage drive start timing after the start of sub-scanning drive of the recording medium using the information related to the time required from the termination of the predetermined deceleration control region to stoppage and time from the start of carriage drive to the start of recording by the recording head, in a case that said determining step determines that the main scanning drive of the carriage can be started before the completion of the sub-scanning drive of the recording medium in the next recording scanning.

* * * * *

UNITED STATES PATENT AND TRADEMARK OFFICE

CERTIFICATE OF CORRECTION

PATENT NO. : 6,729,712 B2
DATED : May 4, 2004
INVENTOR(S) : Kobayashi et al.

It is certified that error appears in the above-identified patent and that said Letters Patent is hereby corrected as shown below:

Title page,
Item [*] Notice, delete the phrase "by 32 days" and insert -- by 0 days --

Signed and Sealed this

Fifteenth Day of February, 2005

JON W. DUDAS
*Director of the United States Patent and Trademark Office*